US007283768B2

(12) United States Patent
Bandou et al.

(10) Patent No.: US 7,283,768 B2
(45) Date of Patent: Oct. 16, 2007

(54) IMAGE FORMING APPARATUS

(75) Inventors: Kouji Bandou, Kanagawa (JP); Makoto Kusayanagi, Kanagawa (JP); Takahiro Suzuki, Kanagawa (JP); Michiko Aida, Kanagawa (JP); Takashi Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 328 days.

(21) Appl. No.: 11/035,130

(22) Filed: Jan. 14, 2005

(65) Prior Publication Data

US 2005/0207788 A1 Sep. 22, 2005

(30) Foreign Application Priority Data

Mar. 22, 2004 (JP) ..... 2004-083029
Aug. 31, 2004 (JP) ..... 2004-253147

(51) Int. Cl.
*G03G 15/04* (2006.01)
*G03G 13/14* (2006.01)

(52) U.S. Cl. ..... 399/159; 399/302; 399/308; 430/60; 430/125.32

(58) Field of Classification Search ..... 430/60, 430/126, 125.32; 399/159, 308, 302
See application file for complete search history.

(56) References Cited

U.S. PATENT DOCUMENTS 5,430,526 A 7/1995 Ohkubo et al.
5,879,847 A 3/1999 Yoshinaga et al.
6,352,809 B1 3/2002 Nukada et al.
2002/0115012 A1 8/2002 Hashizume et al.
2003/0054271 A1 3/2003 Yao
2003/0118927 A1 6/2003 Nakamura et al.
2003/0157420 A1 8/2003 Bando et al.

FOREIGN PATENT DOCUMENTS

JP A 01-211779 8/1989
JP A 09-138539 5/1997
JP A 2002-318459 10/2002
JP A 2003-149950 5/2003
JP A 2003-186219 7/2003

*Primary Examiner*—Mark A. Chapman
(74) *Attorney, Agent, or Firm*—Oliff & Berridge, PLC

(57) ABSTRACT

An image forming apparatus includes an electrophotographic photoreceptor having a conductive substrate; a subbing layer disposed on the conductive substrate and a photosensitive layer disposed on the subbing layer; a charging unit for charging the surface of the photoreceptor; an exposure unit for exposing the surface of the photoreceptor to form an electrostatic latent image; a developing unit for developing the electrostatic latent image with a toner to form a toner image; and a transfer unit having an intermediate transfer. The surface of the intermediate transfer belt has a dynamic hardness of from $22\times10^9$ to $36\times10^9$ N/m$^2$; a dynamic hardness of the surface of the photoreceptor is smaller than the dynamic hardness of the surface of the intermediate transfer belt; and the subbing layer has a thickness of 7 μm or more.

15 Claims, 3 Drawing Sheets

IMAGE FORMING APPARATUS

BACKGROUND OF THE INVENTION

1. Field of the Invention

The present invention relates to an image forming apparatus, and more specifically, to an image forming apparatus provided with an intermediate transfer belt.

2. Description of the Related Art

So far, in an image forming apparatus of the electrophotography system, image formation is carried out by entirely charging an electrophotographic photoreceptor (hereinafter often simply referred to as "photoreceptor") by a charging unit, irradiating the charged photoreceptor with exposure light to form an electrostatic latent image, developing this electrostatic latent image with a toner, and then transferring a toner image onto a medium to be transferred such as paper. And, after optionally removing the residual toner by a cleaning unit, the transferred photoreceptor is repeatedly used for a next image forming process. In the light of the above, since an electric or mechanical external force is directly applied to the surface of an electrophotographic photoreceptor by a charging unit, a developing unit, a transfer unit, a cleaning unit, etc., the electrophotographic photoreceptor is required to have durability against such an external force.

Also, a corona discharge system for generating corona discharge to charge a photoreceptor using corotron or scorotron has hitherto been employed as a charging unit for charging the photoreceptor. However, in the case of the corona discharge system, there is encountered such a problem that the surface of the photoreceptor changes its nature due to corona products generated with the progress of corona discharge, such as ozone and $NO_x$, whereby a phenomenon such as image blurring and deterioration of the photoreceptor takes place. Further, in the case of the corona discharge system, the charging efficiency is so poor that there is a defect of requiring a large electric power for the sake of sufficiently charging the photoreceptor.

Then, in recent years, a contact charging system for bringing a charging member into direct contact with a photoreceptor and applying an electric voltage has been put into practical use in place of the corona discharge system (for example, see JP-A-1-211779). The contact charging system is high in the charging efficiency as compared with the corona discharge system and at the same time, is remarkably low in the generation amount of ozone, etc.

However, in the case of employing such a contact charging system, since a mechanical external force due to the charging member is applied to the surface of the photoreceptor, abrasion of the photoreceptor largely increases. Also, if a local deteriorated portion is present in the photoreceptor, a local high electric field is applied to the deteriorated portion at the time of contact charging to form an electrical pinhole, thereby causing an image quality defect.

Also, the transfer system in such an image forming apparatus is broadly classified into a system for directly transferring a toner image on the surface of the photoreceptor onto a medium to be transferred and a system for primarily transferring a toner image on the surface of the photoreceptor onto an intermediate transfer body such as an intermediate transfer belt and then secondarily transferring the primarily transferred image onto a medium to be transferred (intermediate transfer system). Of these, the intermediate transfer system is broadly utilized especially in a full-color image forming apparatus because it is possible to reproduce a color image by color separating a color original image to form toner images of prescribed colors (for example, black, cyan, magenta, and yellow) and superimposing these toner imagers on the intermediate transfer belt (for example, see JP-A-9-138539).

In the case of employing such an intermediate transfer system, since the surface of the photoreceptor comes into contact with the intermediate transfer belt, damage or an increase of abrasion of the photoreceptor is likely generated, too. Also, if a foreign matter is incorporated into the image forming apparatus, there was the case where in transferring the toner image, the foreign matter sticks into the surface of the photoreceptor to generate leakage of the photoreceptor, thereby causing the generation of an image quality defect. Further, there was a problem that if the foreign matter is large, the stuck foreign matter reaches a substrate of the photoreceptor, thereby readily generating leakage of the photoreceptor.

As a method for improving these problems, for example, a method for enhancing the mechanical strength by making the surface of the electrophotographic photoreceptor hard is reviewed. According to this method, it is designed to suppress the damage or abrasion of the photoreceptor caused due to the employment of the contact charging system or intermediate transfer system. In particular, by making the surface of the photoreceptor thoroughly harder than the surface of the intermediate transfer belt, it is designed to suppress the damage or abrasion of the surface of the photoreceptor caused due to the contact with the surface of the intermediate transfer belt.

However, in the case where the surface of the photoreceptor is made hard while making the surface of the intermediate transfer belt relatively soft, there are generated such inconveniences that in transferring the toner image, the intermediate transfer belt is damaged and that an image quality defect such as out of color registration is generated. Thus, even if the life as the photoreceptor is prolonged, not only the life of the intermediate transfer belt becomes short, but also an image quality defect is likely generated. For this reason, it is difficult to stably form an image having a good image quality over a long period of time as the whole of the image forming apparatus.

Then, a method for not only making the surface of the electrophotographic photoreceptor sufficiently hard but also making the surface of the intermediate transfer belt sufficient hard is reviewed.

However, in this case, since the hard materials come into contact with each other in transferring the toner image, there is encountered such a problem that damage or abrasion is likely generated in both the photoreceptor and the intermediate transfer belt. Further, if the mechanical strength of the photoreceptor and the intermediate transfer belt is high, in removing the residual toners on the surface of the photoreceptor and the intermediate transfer belt by a cleaning unit such as a cleaning blade, there is encountered such a problem that the cleaning blade is likely damaged, the life of the cleaning blade becomes short, and a fragment of the damaged cleaning blade becomes a foreign matter which then sticks into the surface of the photoreceptor, thereby likely generating leakage of the photoreceptor. For this reason, it is difficult to stably form an image having a good image quality over a long period of time as the whole of the image forming apparatus.

SUMMARY OF THE INVENTION

The present invention has been made in view of the above circumstances and provides an image forming apparatus capable of stably forming an image having a good image quality over a long period of time.

The present invention has been found that an image forming apparatus capable of stably forming an image having a good image quality over a long period of time is obtained by making a hardness of the surface of the intermediate transfer belt fall within a specified range, making the hardness of the surface of the electrophotographic photoreceptor smaller that the hardness of surface of the intermediate transfer belt and making the thickness of a subbing layer in the photoreceptor fall within a specified range.

According to a first aspect of the invention, an image forming apparatus includes: a photoreceptor including a conductive substrate, a subbing layer disposed on the conductive substrate, and a photosensitive layer disposed on the subbing layer; a charging unit for charging a surface of the photoreceptor; an exposure unit for exposing the surface of the photoreceptor to form an electrostatic latent image; a developing unit for developing the electrostatic latent image with a toner to form a toner image; and a transfer unit having an intermediate transfer belt and for primarily transferring the toner image onto the intermediate transfer belt and secondarily transferring a primarily transferred image on the intermediate belt onto a recording medium, in which the surface of the intermediate transfer belt has a dynamic hardness of from $22\times10^9$ to $36\times10^9$ N/m$^2$, a dynamic hardness of the surface of the photoreceptor is smaller than the dynamic hardness of the surface of the intermediate transfer belt, and the subbing layer has a thickness of 7 μm or more.

DETAILED DESCRIPTION OF THE PREFERRED EMBODIMENTS

Figure 1:
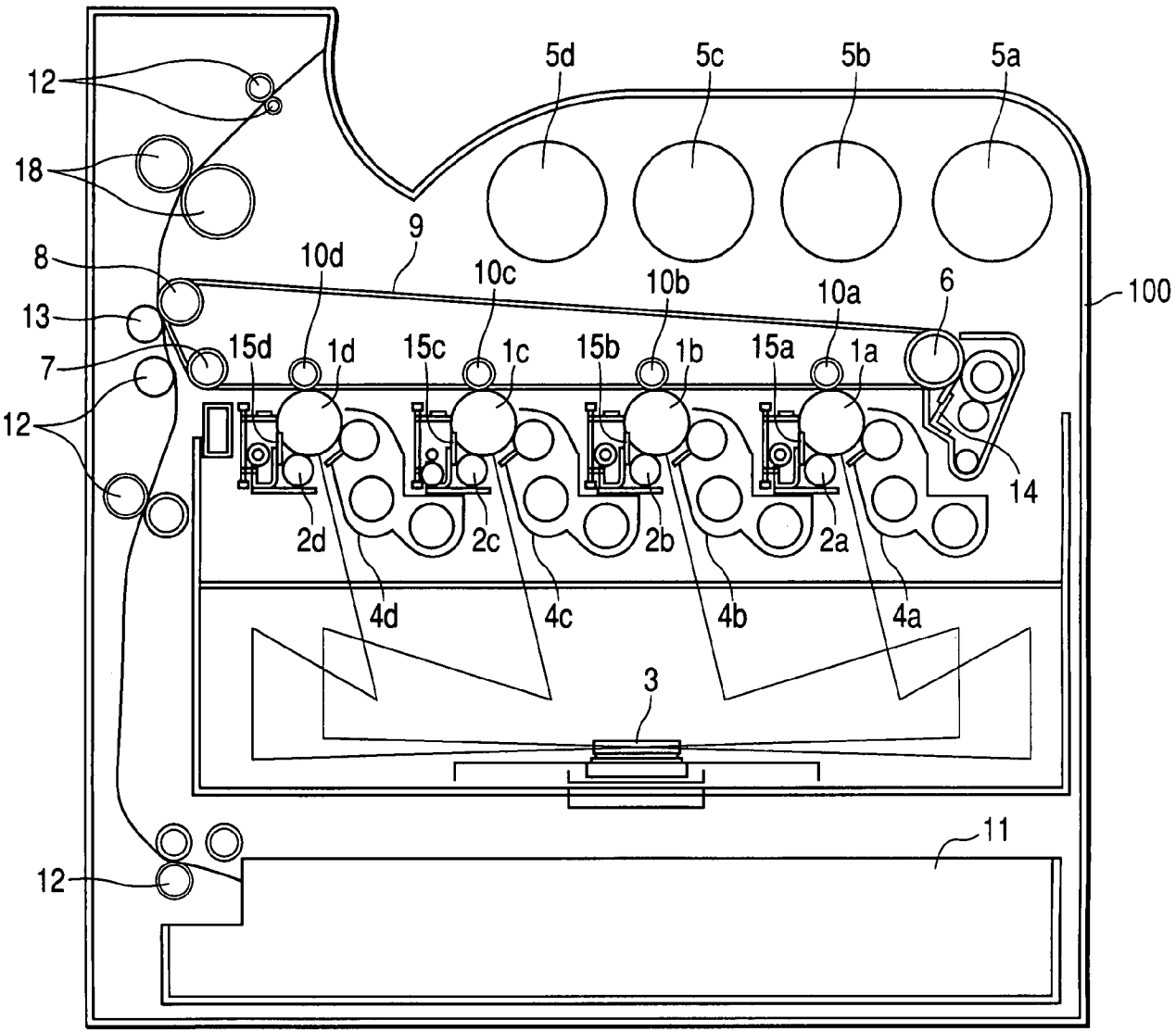
FIG. 1 is a schematic constructive view to show one preferred embodiment of the image forming apparatus of the invention.

Specifically, the image forming apparatus of the invention comprises an electrophotographic photoreceptor having a conductive substrate; a subbing layer disposed on the conductive substrate; and a photosensitive layer disposed on the subbing layer; a charging unit for charging the surface of the photoreceptor; an exposure unit for exposing the surface of the photoreceptor to form an electrostatic latent image; a developing unit for developing the electrostatic latent image with a toner to form a toner image; and a transfer unit having an intermediate transfer belt and for primarily transferring the toner image onto the intermediate transfer belt and secondarily transferring a primarily transferred image on the intermediate belt onto a medium to be transferred, a cleaning unit for removing a residual toner on the surface of the photoreceptor, in which the surface of the intermediate transfer belt has a dynamic hardness of from $22\times10^9$ to $36\times10^9$ N/m$^2$; a dynamic hardness of the surface of the photoreceptor is smaller than the dynamic hardness of the surface of the intermediate transfer belt; and the subbing layer has a thickness of 7 μm or more.

In the image forming apparatus of the invention, a photoreceptor is charged by a charging unit, an electrostatic latent image is then formed upon exposure, and the electrostatic latent image is developed to form a toner image on the surface of the photoreceptor. This toner image is primarily transferred onto an intermediate transfer belt from the photoreceptor and further secondarily transferred onto a medium to be transferred from the intermediate transfer belt. At this time, by not only using, as the intermediate transfer belt, one having a dynamic hardness of the surface falling within the foregoing range but also using, as the photoreceptor, one having a dynamic hardness of the surface smaller than the dynamic hardness of the surface of the intermediate transfer belt, it is possible to thoroughly suppress damage of the photoreceptor and the intermediate transfer belt. Also, it is possible to thoroughly suppress the generation of an image quality defect. Moreover, since the photoreceptor is provided with a subbing layer having a thickness falling within the foregoing range, it is possible to thoroughly reduce a lowering of the photoreceptor characteristics caused due to damage of the surface of the photoreceptor. In particular, in the case where a foreign matter is incorporated into the image forming apparatus and sticks into the surface of the photoreceptor, it is possible to thoroughly prevent a phenomenon that this foreign matter reaches a conductive substrate from occurring, and it is possible to thoroughly suppress the generation of leakage of the photoreceptor caused due to the foreign matter. Thus, according to the image forming apparatus of the invention, it is possible to stably form an image having a good image quality over a long period of time.

Incidentally, the term "dynamic hardness" as referred to in the invention means a value obtained in the following procedures. That is, the dynamic hardness [N/m$^2$] means a value obtained by calculation according to the following expression (a) from values of an indentation depth [m] and an indentation load [N] as measured by using a microhardness tester installed with a diamond indentator having a sharpness of 115° and a tip radius of curvature of not more than 0.1 μm and indenting the diamond indentator into the surface of the photoreceptor or intermediate transfer body at a stress rate of 0.05 N/sec.

$$DH=3.8584P/D^2 \quad \text{(a)}$$

In the expression, DH represents a dynamic hardness (N/m$^2$); P represents an indentation load (N); and D represents an indentation depth (m).

Also, in the image forming apparatus of the invention, it is preferable that the charging unit is a contact charging unit which comes into contact with the surface of the photoreceptor to charge the photoreceptor and that the developing unit is a unit which develops the electrostatic latent image with color toners to form color toner images.

According to such an image forming apparatus, after charging the photoreceptor by the contact charging unit, an electrostatic latent image is formed upon exposure, and the electrostatic latent image is developed to form color toner images on the surface of the photoreceptor. The color toner images are primarily transferred onto the intermediate transfer belt and further secondarily transferred onto the medium to be transferred from the intermediate transfer belt. By using a contact charging unit as such a charging unit, it is possible to obtain a high charging efficiency as compared with the case of using a non-contact type charging unit such as a corona discharge system. Also, it is possible to thoroughly suppress image blurring, deterioration of the photoreceptor, and the like while thoroughly suppressing the generation of ozone, $NO_x$, etc. Further, in the case of using a contact charging unit, by not only using, as the intermediate transfer belt, one having a dynamic hardness of the surface falling within the foregoing range but also using, as the photoreceptor, one having a dynamic hardness of the surface smaller than the dynamic hardness of the surface of the intermediate transfer belt, it is possible to thoroughly suppress damage of the photoreceptor and the intermediate transfer belt, too. Also, it is possible to thoroughly suppress the generation of an image quality defect. Moreover, since the photoreceptor is provided with a subbing layer, it is possible to thoroughly reduce a lowering of the photoreceptor characteristics caused due to abrasion of the surface of the photoreceptor. In particular, in the case where a foreign matter is incorporated into the image forming apparatus and sticks into the surface of the photoreceptor, it is possible to thoroughly prevent a phenomenon that this foreign matter reaches a conductive substrate from occurring, and it is possible to thoroughly suppress the generation of leakage of the photoreceptor caused due to the foreign matter. Thus, according to the image forming apparatus of the invention, it is possible to stably form an image having a good image quality over a long period of time.

Also, in the invention, it is preferable that the surface of the photoreceptor has a dynamic hardness of from $7\times10^9$ to $13\times10^9$ N/m$^2$.

By making the surface of the photoreceptor have a dynamic hardness falling within the foregoing range, it is possible to thoroughly suppress damage of the photoreceptor and the intermediate transfer belt, and it is possible to obtain an image forming apparatus capable of stably forming an image having a good image quality over a longer period of time.

Further, in the invention, it is preferable that the superficial surface layer of the photoreceptor contains a resin particle.

By containing a resin particle in the superficial surface layer of the photoreceptor, it is possible to enhance lubricity and abrasion resistance of the surface of the photoreceptor and desorption properties of the toner. Accordingly, it is possible to more thoroughly suppress damage or abrasion of the surface of the photoreceptor at the time of contacting between the surface of the photoreceptor and the contact charging unit or at the time of contacting with the intermediate transfer belt. Also, since it becomes possible to easily carry out the removal of the residual toner on the surface of the photoreceptor by a cleaning unit under a low pressure, at this time, not only the damage or abrasion of the surface of the photoreceptor is thoroughly suppressed, but also the damage of the cleaning unit is thoroughly suppressed. Accordingly, it is possible to obtain an image forming apparatus capable of stably forming an image having a good image quality over a longer period of time.

The term "superficial surface layer of the photoreceptor" as referred to herein means a layer to be disposed on the farthest side from the conductive substrate among the layers constructing the photoreceptor. For example, depending upon the structure of the photoreceptor, there are the case where the superficial surface layer is corresponding to a photosensitive layer and the case where the superficial surface layer is corresponding to a protective layer formed on the photosensitive layer. Also, in the case where the photosensitive layer is a photosensitive layer of a so-called function separation type constructed by a charge generation layer and a charge transport layer and the photosensitive layer is positioned in the uppermost portion of the photoreceptor, one of the charge generation layer and the charge transport layer, to which the toner adheres, becomes the superficial surface layer.

Also, in the invention, it is preferable that the subbing layer contains a metal oxide fine particle and a binding resin and has a volume resistivity when applied with an electric field of $1\times10^6$ V/m at 28° C. and 85% RH, of from $1\times10^8$ to $1\times10^{13}$ Ω·cm and a volume resistivity when applied with an electric field of $1\times10^6$ V/m at 10° C. and 15% RH, of not more than 500 times the volume resistivity when applied with an electric field of $1\times10^6$ V/m at 28° C. and 85% RH.

When the photoreceptor is provided with such a subbing layer, both leakage preventing properties and electric characteristics are thoroughly enhanced, and a good image quality can be obtained over a longer period of time without generating an image quality defect. Also, it is possible to design to realize size reduction and high speed of the image forming apparatus while keeping a good image quality.

In order to design to realize size reduction of the image forming apparatus, it is necessary to make the diameter of the photoreceptor small and to increase the process speed. However, in image forming apparatuses of the related art, if the image formation is carried out at a fast process speed over a long period of time, the charging properties of the photoreceptor become unstable, resulting in causing a problem that the image density changes. In contrast, according to an image forming apparatus using the foregoing photoreceptor provided with a subbing layer, it is possible to make the charging properties of the photoreceptor stable even in the case where the image formation is carried out over a long period of time. Accordingly, in such an image forming apparatus, by the matter that the photoreceptor is provided with the foregoing subbing layer, it becomes possible to design to realize size reduction and high speed of the apparatus while keeping a good image quality.

Also, in the invention, the photosensitive layer can contain hydroxygallium phthalocyanine.

When the photosensitive layer has such a construction, it is possible to reveal excellent electrophotographic characteristics, and it is possible to obtain an image forming apparatus capable of forming an image having a good image quality.

Also, in the invention, it is preferable that the intermediate transfer belt contains a thermosetting polyimide containing at least one kind of carbon black.

When the intermediate transfer belt has the foregoing construction, not only it is possible to easily form an intermediate transfer belt having a dynamic hardness falling within the above specified range, but also it is possible to enhance the abrasion resistance and electric characteristics of the intermediate transfer belt. For these reasons, it is possible to obtain an image forming apparatus capable of stably forming an image having a good image quality over a longer period of time.

According to the invention, it is possible to provide an image forming apparatus capable of stably forming an image having a good image quality over a long period of time.

Preferred embodiments of the invention will be described below in detail while often referring to the drawings. Incidentally, in the drawings, the same symbols are given to the same or equivalent portions, and overlapping explanations are omitted.

FIG. 1 is a schematic constructive view to show one preferred embodiment of the image forming apparatus of the invention. The apparatus illustrated in FIG. 1 is an image forming apparatus of a so-called tandem system, and four electrophotographic photoreceptors 1*a* to 1*d* are mutually disposed in parallel along an intermediate transfer belt 9 within a housing 100.

The photoreceptors 1*a* to 1*d* can be respectively rotated in a prescribed direction (a counterclockwise direction on the paper); and charging rolls (charging units) 2*a* to 2*d*, developing units 4*a* to 4*d*, primary transfer rolls 10*a* to 10*d*, and cleaning blades 15*a* to 15*d* are disposed along the rotation direction. Toners (color toners) of four colors of black, yellow, magenta and cyan contained in toner cartridges 5*a* to 5*d* can be fed into the developing units 4*a* to 4*d*, respectively, and the primary transfer rolls 10*a* to 10*d* come into contact with the photoreceptors 1*a* to 1*d*, respectively via the intermediate transfer body 9. Further, a laser source 3 is disposed in a prescribed position within the housing 100, and laser light which comes out from the laser source 3 can be irradiated on the surfaces of the photoreceptors 1*a* to 1*d* after charging. According to this construction, in the rotation step of the photoreceptors 1*a* to 1*d*, the respective charging, exposure, development, primary transfer and cleaning steps are carried out in sequence, and toner images of the respective colors are superimposed and transferred on the intermediate transfer belt 9.

The intermediate transfer belt 9 is supported by a drive roll 6, a backup roll 7, and a tension roll 8 with a prescribed tension and can be rotated by rotation of these rolls without generating a warp. Also, a secondary transfer roll 13 is disposed such that it comes into contact with the backup roll 7 via the intermediate transfer body 9. The intermediate transfer belt which has passed between the backup roll 7 and the secondary transfer roll 13 is cleaned up by cleaning blades 14 and then repeatedly provided in a next image forming process.

Also, a tray 11 is provided in a prescribed position within the housing 100, and a medium to be transferred (for example, paper) in the tray 11 is conveyed between the intermediate transfer belt 9 and the secondary transfer roll 13 and further between two fixing rolls 18 which come into contact with each other in sequence by conveying rolls 12 and then discharged out the housing 100.

(Electrophotographic Photoreceptor)

Figure 2:
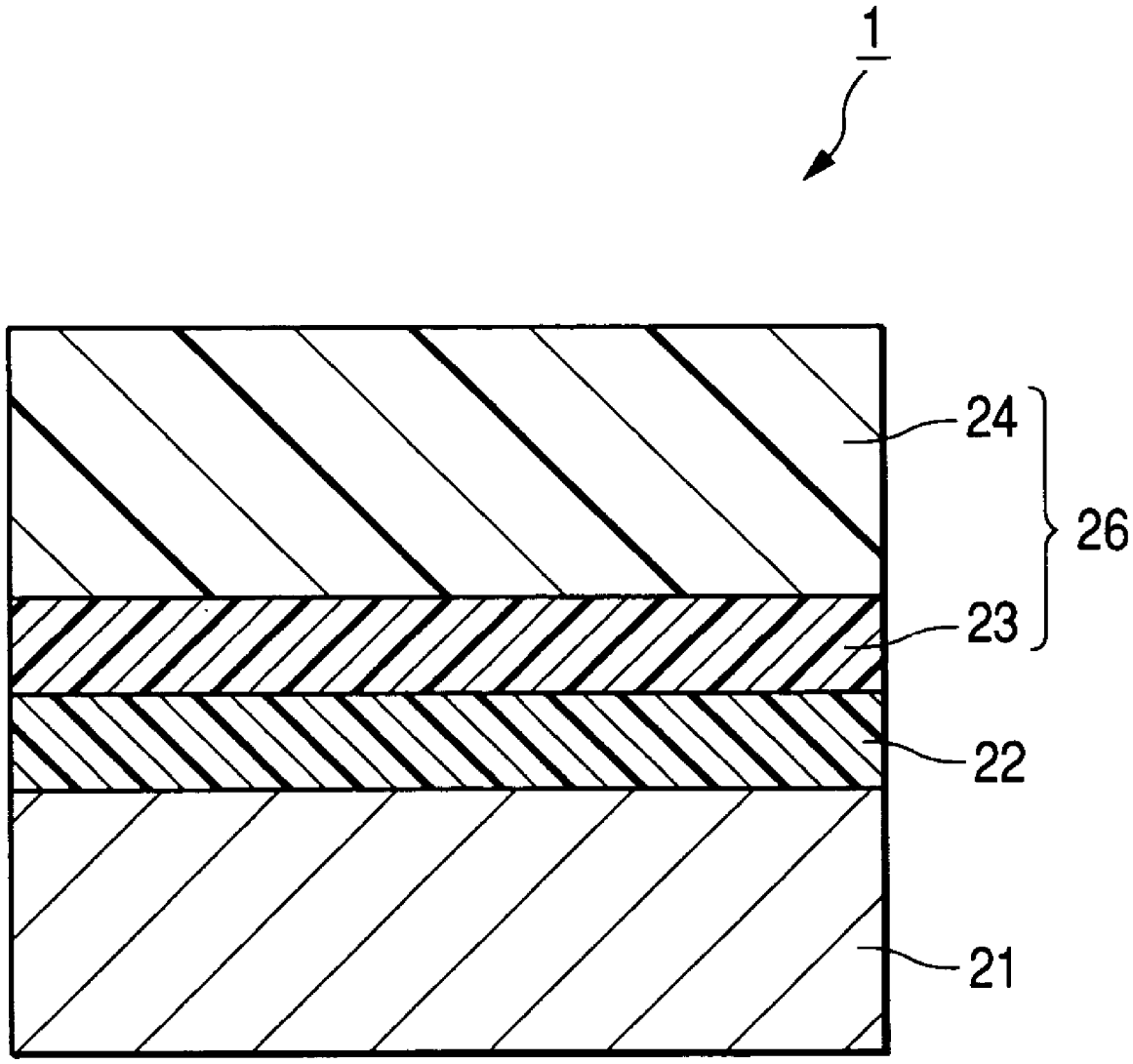
FIG. 2 is a schematic cross-sectional view to show one preferred example of the electrophotographic photoreceptor according to the invention.

FIG. 2 is a cross-sectional view to schematically show the construction of the photoreceptors 1*a* to 1*d* (referred to simply as "photoreceptor 1" in the explanation of FIG. 2). In FIG. 2, the photoreceptor 1 has a construction that a subbing layer 22, a charge generation layer 23, and a charge transport layer 24 are laminated on a conductive substrate 21 in sequence, and a photosensitive layer 26 includes the charge generation layer 23 and the charge transport layer 24. The dynamic hardness of the surface of the photoreceptor 1 is smaller than the dynamic hardness of the surface of the intermediate belt 9, and the thickness of the subbing layer 22 is 7 μm or more. Incidentally, the dynamic hardness of the surface of the photoreceptor 1 can be adjusted by properly choosing materials (for example, binding resins) of the layers 23 to 24 constructing the photosensitive layer 26 and the subbing layer 22, the curing conditions of the binding resin, and so on.

The conductive substrate 21 is, for example, one prepared by molding aluminum in a cylindrical (drum-like) form. As the substrate 21, though an aluminum pipe stock may be used as it is, it may be previously subjected to a treatment such as mirror grinding, etching, anodic oxidation, rough cutting, centerless grinding, sand blast, and wet honing.

Besides aluminum, examples of the material of the conductive substrate 21 include metal materials such as stainless steel and nickel; high molecular materials such as polyethylene terephthalate, polybutylene terephthalate, polypropylene, nylons, polystyrenes, and phenol resins; materials prepared by subjecting an insulating material (for example, hard papers) to a conductive treatment upon dispersing a conductive substance (for example, carbon black, indium oxide, tin oxide, antimony oxide, metals, and copper iodide); materials prepared by laminating the foregoing insulating material with a metal foil; and materials prepared by forming a vapor deposition film of a metal on the foregoing insulating material. Also, the shape of the substrate 21 may be in the sheet-like form or plate-like form.

The subbing layer 22 is a layer having a function to prevent injection of a charge from the conductive substrate 21 to the photosensitive layer 26 at the time of charging the photosensitive layer 26.

Though the subbing layer 22 includes a material arbitrarily selected from binding resins, organic or inorganic powders, and electron transporting substances, it is preferably constructed while containing a metal oxide fine particle and a binding resin. When the subbing layer 22 containing a metal oxide fine particle and a binding resin is formed between the conductive substrate 21 and the photosensitive layer 26, both the leakage preventing properties and the electric characteristics are thoroughly enhanced. As a result, even in the case of joint use with a contact charging unit as described later, it becomes possible to obtain a good image quality without generating an image quality defect such as fog.

Also, it is preferable that the subbing layer 22 has a volume resistivity when applied with an electric field of $1\times10^6$ V/m at 28° C. and 85% RH, of from $1\times10^8$ to $1\times10^{13}$ Ω·cm (more preferably from $1\times10^8$ to $1\times10^{11}$ Ω·cm) and a volume resistivity when applied with an electric field of $1\times10^6$ V/m at 10° C. and 15% RH, of not more than 500 times (more preferably not more than 100 times) the volume resistivity when applied with an electric field of $1\times10^6$ V/m at 28° C. and 85% RH. When the subbing layer 22 meets these conditions, both the leakage preventing properties and the electric characteristics are thoroughly enhanced, and the image forming apparatus can obtain a good image quality over a longer period of time without generating an image quality defect.

The volume resistivity of the subbing layer 22 can be controlled within the foregoing range by, for example, properly choosing the kinds and compounding amounts of the metal oxide fine particle and the binding resin and further enhancing dispersibility of the metal oxide fine particle into the binding resin.

Examples of the metal oxide fine particle include tin oxide, titanium oxide, zinc oxide, and aluminum oxide. Also, the value of powder resistance of the metal oxide fine particle is preferably from $10^2$ to $10^{11}$ Ω·cm, and more preferably from $10^4$ to $10^{10}$ Ω·cm. When the value of powder resistance of the metal oxide fine particle is less than $10^2$ Ω·cm, sufficient leakage preventing properties tend to be not obtained. On the other hand, when the value of powder resistance exceeds $10^{11}$ Ω·cm, anincrease of the residual potential in the image forming apparatus tends to likely take place.

Also, the average primary particle size of the metal oxide fine particle is preferably not more than 100 nm, and more preferably from 10 to 90 nm. When the average primary particle size of the metal oxide fine particle exceeds 100 nm, the dispersibility into the binding resin tends to be lowered. As a result, it tends to become difficult to cope with both the leakage preventing properties and the electric characteristics.

These preferred metal oxide fine particles can be obtained by known production processes. For example, in the case of zinc oxide, it can be produced by the indirect process (French process) described in JIS K1410, the direct process (American process), the wet process, the arc plasma process, etc.; and in the case of titanium oxide, it can be produced by the sulfuric acid process, the chlorine process, the hydrofluoric acid process, the titanium chloride potassium process, the titanium tetrachloride aqueous solution process, the are plasma process, etc.

It is preferable that the metal oxide fine particle is subjected to a coating treatment with at least one coupling agent selected from the group consisting of a silane coupling agent, a titanate based coupling agent, and an aluminate based coupling agent. By using the metal oxide fine particle having been subjected to a coating treatment with a coupling agent, not only the dispersibility of the metal oxide fine particle into the binding resin is more enhanced, but also it becomes possible to easily and surely control the volume resistivity and circumferential reliability of the subbing layer 22, and it is possible to more enhance both the leakage preventing properties and the electric characteristics.

Here, examples of the silane coupling agent include vinyltrimethoxysilane, γ-methacryloxypropyl-tris(β-methoxy-ethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Examples of the titanate based coupling agent include isopropyltriisostearoyl titanate, bis(dioctylpyrophosphate) titanate, and isopropyltris(N-aminoethyl-aminoethyl) titanate.

Examples of the aluminate based coupling agent include acetoalkoxy aluminum diisopropylates.

These coupling agents may be used singly or in combinations of two or more kinds thereof.

Also, of these, amino group-containing coupling agents such as γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and isopropyltri-(N-aminoethyl) titanate are preferable because the coating treatment with such a coupling agent can be efficiently and surely carried out. Coupling agents containing two amino groups such as N-β-(aminoethyl)-γ-aminopropyltrimethoxysilane and N-β-(aminoethyl)-γ-aminopropylmethylmethoxysilane are more preferable.

The coating treatment using such a coupling agent can be carried out by dissolving a coupling agent in a solvent and dispersing a metal oxide fine particle in the solution (treating liquid). Examples of the solvent include toluene, ethylbenzene, tetrahydrofuran, ethyl acetate, butyl acetate, methylene chloride, chloroform, chlorobenzene, acetone, methyl ethyl ketone, and methanol. Of these, high boiling solvents such as toluene are preferable for use.

Also, in preparing the treating liquid, the coupling agent can be dispersed in the solvent by using stirring, ultrasonic wave, a sand mill, an attritor, a ball mill, etc. Also, the treatment temperature can be arbitrarily set up within the range of from room temperature to the boiling point of the solvent. Further, though the amount of the solvent to the metal oxide fine particle can be arbitrarily set up, a weight ratio of the metal oxide fine particle to the solvent is preferably from 1/1 to 1/10, and more preferably from 1/2 to 1/4. When the weight of the solvent is less than one time the weight of the metal oxide fine particle, not only the stirring may possibly become difficult, thereby causing gelation, but also the uniform treatment tends to become difficult. On the other hand, when the weight of the solvent exceeds 10 times the weight of the metal oxide fine particle, the unreacted coupling agent tends to likely remain. Also, the amount of the coupling agent is preferably not more than 10 parts by weight, and more preferably from 0.1 to 5.0 parts by weight based on 100 parts by weight of the metal oxide fine particle from the standpoints of electric characteristics, image quality keeping properties, film forming properties, and so on.

Though the foregoing coating treatment is carried out under stirring, in order to more uniformly perform the coating with a coupling agent, it is preferred to use a dispersion medium (preferably ones having a median diameter of from 0.5 to 50 mm) such as a silica gel and zirconia. Further, in the case where when the solvent is removed from the mixture after the coating treatment, the metal oxide fine particle causes coagulation, it is preferred to previously pulverize it before the sequent heat treatment. Also, for the sake of rapidly removing the solvent after the coating treatment, it is preferred to perform distillation under a prescribed pressure condition (preferably from 0.133 hPa to 1,1013 hPa (from 0.1 to 760 mmHg)). Incidentally, though it is possible to remove the solvent by filtration, since the unreacted coupling agent is liable to flow out and it becomes difficult to control the amount of the coupling agent necessary for obtaining the desired characteristics, such is not preferable.

Also, it is preferable that the surface coating rate of the coupling agent in the metal oxide fine particle after the coating treatment is from 7 to 20%. When the surface coating rate is less than 7%, it is impossible to thoroughly increase the resistivity value of the metal oxide fine particle, and the blocking properties of the subbing layer 22 are lowered, whereby the image quality tends to become worse. On the other hand, when the surface coating rate exceeds 20%, the residual potential is liable to increase with the repeated use of the electrophotographic photoreceptor, and the circumferential fluctuation of the volume resistivity tends to increase. Incidentally, the "surface coating rate" as referred to herein means a rate [%] of the surface of the metal oxide fine particles coated with the coupling agent and is determined based on the BET specific surface area of the metal oxide fine particle before the coating treatment and the compounding amount of the coupling agent.

That is, the weight of the coupling agent necessary for achieving the surface coating rate of 100% is given by the following expression.

(Weight [g] of coupling agent necessary for achieving the surface coating rate of 100%)={(Weight [g] of metal oxide fine particle)×(BET specific surface area [$m^2$/g] of metal oxide)}/(Minimum coating area [$m^2$/g] of coupling agent)

In the expression, the "minimum coating area of the coupling agent" as referred to herein means a minimum area capable of being coated when one gram of the coupling agent forms a monomolecular film.

The surface coating rate can be determined according to the following expression.

(Surface coating rate [%])=100×(Weight [g] of coupling agent used in the coating treatment)/(Weight [g]of coupling agent necessary for achieving the surface coating rate of 100%)

The thus coating treated metal oxide fine particle can be subjected to a prescribed heat treatment. By performing the heat treatment, it is possible to make the formation of a film by the reaction of the coupling agent more complete. Here, the heat treatment temperature is preferably 120° C. or higher, more preferably from 200 to 300° C., and further preferably from 200 to 250° C. When the heat treatment temperature is lower than 120° C., the residual adsorbed water and coupling agent are not sufficiently removed, whereby the electric characteristics such as dark decay tend to become insufficient. On the other hand, when the heat treatment temperature exceeds 300° C., a trap site of the charge appears due to decomposition of the film formed by the coupling agent or oxidation of the surface of the metal oxide fine particle, whereby the residual potential tends to likely increase. Also, though the heat treatment time is properly chosen depending upon the kind of the coupling agent and the heat treatment temperature, it is usually from approximately 10 minutes to 100 hours.

Also, in heat treating the metal oxide fine particle having been subjected to coating treatment, the heat treatment can be carried out in plural stages having a varied heat treatment temperature, and it is preferred to perform a heat treatment of a separate step before performing the foregoing heat treatment. At this time, the temperature of the heat treatment of a separate step is preferably the boiling point of the solvent or higher.

By using the metal oxide fine particle which has been subjected to the foregoing coating treatment with a coupling agent and heat treatment, the dispersibility of the metal oxide fine particle into the binding resin is enhanced, whereby it becomes possible to easily and surely control the volume resistivity of the subbing layer 22 and its circumferential reliability. As a result, it is possible to more enhance both the leakage preventing properties and the electric properties.

Examples of the binding resin which is used in the subbing layer 22 include high molecular resin compounds such as acetal resins (for example, polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, and melamine resins.

The subbing layer 22 may be made of only a metal oxide fine particle and a binding resin. Also, so far as the volume resistivity and its circumferential reliability meet the foregoing conditions, the subbing layer 22 may contain additives for enhancing the electric characteristics, circumferential stability and image quality. Examples of such additives include quinone based compounds such as chloranil quinone, bromoanil quinone, and anthraquinone; tetracyanoquinodimethane based compounds; fluorenone compounds such as 2,4,7-trinitrofluorenone and 2,4,5,7-tetranitro-9-fluorenone; oxadiazole based compounds such as 2-(4-biphenyl)-5-(4-t-butylphenyl)-1,3,4-oxazdiazole, 2,5-bis-(naphthyl)-1,3,4-oxadiazole, and 2,5-bis(4-diethylaminophenyl)-1,3,4-oxadiazole; xanthone based compounds; thiophene compounds; electron transporting substances such as diphenoquinone compounds (for example, 3,3',5,5'-tetra-t-butyldiphenoquinone); electron transporting pigments such as polycyclic fused based pigments and azo based pigments; silane coupling agents; zirconium chelate compounds; titanium chelate compounds; aluminum chelate compounds; titanium alkoxide compounds; and organotitanium compounds.

Here, examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetyl acetonate zirconium butoxide, ethyl acetoacetate zirconium butoixe, zirconium acetate, zirconium oxalate, zirconium lactate, zirconium phosphonate, zirconium octanoate, zirconium naphthenate, zirconium laurate, zirconium stearate, zirconium isostearte, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxytitanium stearate.

Examples of the aluminum chelate compound include aluminum isopropiolate, monobutoxyaluminum diisopropiolate, aluminum butyrate, diethyl acetoacetate, aluminum diisopropiolate, and aluminum tris(ethyl acetoacetate). These compounds can be used singly or as a mixture of plural compounds or a polycondensate thereof.

The subbing layer 22 can be, for example, formed by mixing/dispersing a metal oxide fine particle and a binding resin in a prescribed solvent such as aromatic compounds (for example, toluene and chlorobenzene), amides (for example, dimethylformamide and N-methylpyrrolidone), aliphatic alcohols (for example, methanol, ethanol, and butanol), aliphatic polyhydric alcohols (for example, ethylene glycol, glycerin, and polyethylene glycol), aromatic alcohols (for example, benzyl alcohol and phenethyl alcohol), esters (for example, ethyl acetate and butyl acetate), ketones (for example, acetone and methyl ethyl ketone), dimethyl sulfoxide, and ethers (for example, diethyl ether and tetrahydrofuran), and a mixed system of plural kinds thereof, to prepare a coating liquid for forming a subbing layer, coating this coating liquid on the conductive substrate 21, and then drying it.

Examples of a mixing/dispersing method which can be employed for preparing such a coating liquid include methods by a paint conditioner, a ball mill, a sand mill, an attritor, ultrasonic wave, and so on. Also, examples of a coating method of the coating liquid include a blade coating process, a wire bar coating process, a spray coating process, a dip coating process, a bead coating process, an air knife coating process, and a curtain coating process. Also, for the sake of enhancing the smoothness of a coating film, it is possible to add a trace amount of silicone oil as a leveling agent to the coating liquid.

While the thickness of the thus obtained subbing layer 22 is required to be 7 μm or more, it is preferably 15 μm or more, more preferably from 15 to 30 μm, and especially preferably from 18 to 30 μm. When the thickness of the subbing layer 22 is less than 7 μm, sufficient leakage preventing properties are not obtained. Also, in the case where a foreign matter sticks into the surface of the photoreceptor, it is difficult to thoroughly prevent a phenomenon that the foreign matter reaches the conductive substrate from occurring. Incidentally, when the thickness of the subbing layer 22 exceeds 30 μm, the film formation tends to become difficult, and a lowering of the image quality caused due to an increase of the residual potential tends to be likely generated.

The charge generation layer 23 is constructed such that it contains a charge generation material and optionally a binding resin.

Though the charge generation material is not particularly limited, it is preferred to use a phthalocyanine based pigment. By using a phthalocyanine based pigment, it is possible to obtain the electrophotographic photoreceptor 1 having a high sensitivity and excellent repeated stability. Incidentally, the phthalocyanine based pigment includes several kinds of crystal forms. So far as the sensitivity adaptive to the object is obtained, the crystal form of the pigment is not particularly limited. Specific examples of the charge generation material which is especially preferably used will be given below.

As the charge generation substance in the invention, ones which are known can be used without particular limitations, and metal or non-metal phthalocyanine pigments are especially preferable. Of these, hydroxygallium phthalocyanine, chlorogallium phthalocyanine, dichlorotin phthalocyanine, and titanyl phthalocyanine, each having a specified crystal form, are preferable; and hydroxygallium phthalocyanine is especially preferable because it exhibits excellent electrophotographic characteristics.

As the hydroxygallium phthalocyanine, one having absorption within the range of from 810 to 839 nm of a maximum peak in the range of from 600 to 900 nm of a spectral absorption spectrum is preferable. In the case of using hydroxygallium phthalocyanine having such absorption as the material of the electrophotographic photoreceptor, sufficient sensitivity, charging properties and dark decay characteristics are obtained, whereby it becomes possible to obtain a stable image quality over a long period of time.

Also, the value of the specific surface area by the BET method of the hydroxygallium phthalocyanine is preferably 45 $m^2/g$ or more, more preferably 50 $m^2/g$ or more, and further preferably 55 $m^2/g$ or more. Further, it is preferable that the hydroxygallium phthalocyanine has diffraction peaks at Bragg angles ($2\theta \pm 0.2°$) against CuKα characteristic X-rays of 7.5°, 9.9°, 12.5°, 16.3°, 18.6°, 25.1°, and 28.3°.

The foregoing preferred hydroxygallium phthalocyanine can be, for example, obtained by the following methods.

First of all, crude gallium phthalocyanine is produced by a method of reacting o-phthalodinitrile or 1,3-diiminoisoindoline with gallium trichloride in a prescribed solvent (I-type chlorogallium phthalocyanine method); a method of heating and reacting o-phthalodinitrile, an alkoxygallium, and ethylene glycol in a prescribed solvent to synthesize a phthalocyanine dimer (phthalocyanine dimer method); and the like. As the solvent in the foregoing reactions, inert and high boiling solvents such as α-chloronaphthalene, β-chloronaphthalene, α-methylnaphthalene, methoxynaphthalene, dimethylaminoethanol, diphenylethane, ethylene glycol, dialkyl ethers, quinoline, sulforane, dichlorobenzene, dimethylformamide, dimethyl sulfoxide, and dimethylsulfonamide are preferable for use.

Next, the crude gallium phthalocyanine obtained in the foregoing step is subjected to an acid pasting treatment, thereby atomizing the crude gallium phthalocyanine and converting it into an I-type hydroxygallium phthalocyanine pigment. Specifically, the "acid pasting treatment" as referred to herein means a treatment in which a solution prepared by dissolving the crude gallium phthalocyanine in an acid such as sulfuric acid or an acid salt (for example, a sulfate) of the crude gallium phthalocyanine is poured into an alkaline aqueous solution, water or ice water to achieve recrystallization. As the acid to be used for the foregoing acid pasting treatment, sulfuric acid is preferable, and sulfuric acid having a concentration of from 70 to 100% (especially preferably from 95 to 100%) is more preferable.

Next, the I-type hydroxygallium phthalocyanine pigment obtained by the foregoing acid pasting treatment is subjected to crystal conversion by a wet pulverization treatment together with a solvent, to obtain the desired hydroxygallium phthalocyanine pigment. Here, the wet pulverization treatment is preferably carried out in a pulverization device using a spherical medium having an outer diameter of from 0.1 to 3.0 mm, and especially preferably from 0.2 to 2.5 mm. In the case where the outer diameter of the medium is larger than 3.0 mm, the pulverization efficiency is lowered so that the particle size does not become small, whereby a coagulation product is liable to be formed. On the other hand, in the case where the outer diameter of the medium is small than 0.1 mm, the hydroxygallium phthalocyanine is hardly separated from the medium. Further, in the case where the medium is in other form than the spherical form, such as a columnar form and an amorphous form, not only the pulverization efficiency is lowered, but also the medium is liable to be abraded due to the pulverization, and an abraded powder becomes an impurity, thereby likely deteriorating the characteristics of the hydroxygallium phthalocyanine.

Though the material of the medium is not particularly limited, ones which hardly generate an image quality defect even when they are incorporated into the pigment are preferable. For example, glass, zirconia, alumina, agate, and so on can be preferably used. Though the material of the container is not particularly limited, ones which hardly generate an image quality defect even when they are incorporated into the pigment are preferable. For example, glass, zirconia, alumina, agate, polypropylene, polytetrafluoroethylene, polyphenylene sulfide, and so on can be preferably used. Also, an internal surface of a metal container made of iron, stainless steel, etc. may be lined with glass, polypropylene, polytetrafluoroethylene, polyphenylene sulfide, etc.

The amount of the medium to be used varies depending upon the device to be used but is chosen within the range of 50 parts by weight or more, and preferably from 55 to 100 parts by weight based on one part by weight of the I-type hydroxygallium phthalocyanine pigment. Also, when the outer diameter of the medium is small, even if the weight is identical, the medium density occupied within the device increases, and the viscosity of the mixed solution increased, whereby the pulverization efficiency changes. Accordingly, it is desired to perform the wet treatment in an optimum mixing ratio while properly controlling the amount of the medium to be used and the amount of the solvent to be used with a decrease of the outer diameter of the medium.

Also, the temperature of the wet pulverization treatment is in the range of from 0 to 100° C., preferably from 5 to 80° C., and more preferably from 10 to 50° C. In the case where the temperature is too low, the rate of crystal transition is low. On the other hand, in the case where the temperature is too high, the solubility of the hydroxygallium phthalocyanine becomes high so that the crystal growth likely proceeds, whereby it becomes difficult to perform atomization.

Examples of the solvent which is used in the wet pulverization treatment include amides such as N,N-dimethylformamide, N,N-dimethylacetamide, and N-methylpyrrolidone; esters such as ethyl acetate, n-butyl acetate, and isoamyl acetate; ketones such as acetone, methyl ethyl ketone, and methyl isobutyl ketone; and dimethyl sulfoxide.

The amount of the solvent to be used is usually chosen within the range of from 1 to 200 parts by weight, and preferably from 1 to 100 parts by weight based on one part by weight of the hydroxygallium phthalocyanine pigment.

Examples of the device which can be used in the wet pulverization treatment include devices using a medium as a dispersion medium, such as a vibration mill, an automatic mortar, a sand mill, a Dyno mill, a Cobol mill, an attritor, a planetary ball mill, and a ball mill.

The proceeding speed of the crystal conversion is largely affected by the scale of the wet pulverization treatment step, the stirring speed, the material of the medium, etc. The treatment is continued until the I-type hydroxygallium phthalocyanine is converted into the foregoing hydroxygallium phthalocyanine while monitoring the crystal conversion state by the measurement of absorbing wavelength of the wet pulverization treating liquid so as to have absorption within the range of from 810 to 839 nm of a maximum peak in the range of from 600 to 900 nm of a spectral absorption spectrum of the hydroxygallium phthalocyanine. In general, the wet pulverization treatment is carried out for a treatment time in the range of from 5 to 500 hours, and preferably from 7 to 300 hours. When the treatment time is shorter than 5 hours, the crystal conversion is not completed, and a lowering of the electrophotographic characteristics, especially a problem of shortage of the sensitivity is likely caused. On the other hand, when the treatment time exceeds 500 hours, a lowering of the sensitivity is generated due to the influence of a pulverization stress, and problems such as a lowering of the productivity and incorporation of an abraded powder of the medium are generated. By determining the wet pulverization treatment time in this way, it becomes possible to complete the wet pulverization treatment in the state that the hydroxygallium phthalocyanine particle is uniformly atomized.

Pigments other than the foregoing hydroxygallium phthalocyanine pigment can be produced by mechanically dry pulverizing a pigment crystal produced by known methods in an automatic mortar, a planetary mill, a vibration mill, a CF mill, a roller mill, a sand mill, a kneader, etc., or after the dry pulverization, subjecting to a wet pulverization treatment together with a solvent in a ball mill, a mortar, a sand mill, a kneader, etc.

Examples of the solvent which is used in the wet pulverization treatment include aromatic compounds (for example, toluene and chlorobenzene), amides (for example, dimethylformamide and N-methylpyrrolidone), aliphatic alcohols (for example, methanol, ethanol, and butanol), aliphatic polyhydric alcohols (for example, ethylene glycol, glycerin, and polyethylene glycol), aromatic alcohols (for example, benzyl alcohol and phenethyl alcohol), esters (for example, ethyl acetate and butyl acetate), ketones (for example, acetone and methyl ethyl ketone), dimethyl sulfoxide, and ethers (for example, diethyl ether and tetrahydrofuran), mixed systems of plural kinds thereof, and mixed systems of water and these organic solvents. The amount of the solvent to be used is preferably from 1 to 200 parts by weight, and more preferably from 10 to 100 parts by weight based on one part by weight of the pigment crystal. Also, the treatment temperature in the wet pulverization treatment is preferably from 0° C. to the boiling point of the solvent, and more preferably from 10 to 60° C. Also, in the pulverization, a grinding auxiliary such as salt can be used. The amount of the grinding auxiliary to be used is preferably from 0.5 to 20 times, and more preferably from 1 to 10 times the amount of the pigment (on a weight basis).

Further, the pigment crystal which is produced by known methods can be subjected to crystal control by acid pasting or a combination of acid pasting with the foregoing dry pulverization or wet pulverization. As the acid to be used in the acid pasting, sulfuric acid is preferable; its concentration is preferably from 70 to 100%, and more preferably from 95 to 100%; and the amount of sulfuric acid is preferably from 1 to 100 times, and more preferably from 3 to 50 times the weight of the pigment crystal (on a weight basis). Also, the dissolution temperature is preferably from −20 to 100° C., and more preferably from 0 to 60° C. As a solvent to be used in depositing the crystal from the acid, water or a mixed solvent of water and an organic solvent is used in an arbitrary amount. The temperature in performing the deposition is not particularly limited, but it is preferable that the deposition is carried out while cooling with ice, etc. for the purpose of preventing the generation of heat.

These charge generation materials may be subjected to a coating treatment with a hydrolyzable group-containing organometallic compound or a silane coupling agent. By such a coating treatment, the dispersibility of the charge generation material and the coating properties of the coating liquid for charge generation layer are enhanced, whereby it becomes possible to easily and surely form the charge generation layer having smoothness and high dispersion uniformity. As a result, not only it is possible to prevent an image defect such as fog and ghost from occurring, but also it is possible to enhance image quality keeping properties. Also, since the preservability of the coating liquid for charge generation layer is markedly enhanced, such is effective in view of prolongation of a pot life. Also, it is possible to reduce costs of the photoreceptor.

The foregoing hydrolyzable group-containing organometallic compound or silane coupling agent is preferably a compound represented by the following general formula (1).

$$R_p\text{-}M\text{-}Y_q \quad (1)$$

In the formula, R represents an organic group; M represents a metal atom other than an alkali metal or a silicon atom; Y represents a hydrolyzable group; and p and q each represents an integer of from 1 to 4, and the sum of p and q is corresponding to the valence of M.

In the foregoing general formula (1), examples of the organic group represented by R include an alkyl group (for example, a methyl group, an ethyl group, a propyl group, a butyl group, and an octyl group); an alkenyl group (for example, a vinyl group and an allyl group); a cycloalkyl group (for example, a cyclohexyl group); an aryl group (for example, a phenyl group and a naphthyl group); an alkaryl group (for example, a tolyl group); an arylakyl group (for example, a benzyl group and a phenylethyl group); an arylalkenyl group (for example, a styryl group); and a heterocyclic residue (for example, a furyl group, a thienyl group, a pyrrolidinyl group, a pyridyl group, and an imidazoyl group). These organic groups may have one or two or more kinds of a varied substituent.

Also, in the foregoing general formula (1), examples of the hydrolyzable group represented by Y include an ether group (for example, a methoxy group, an ethoxy group, a propoxy group, a butoxy group, a cyclohexyloxy group, a phenoxy group, and a benzyloxy group); an ester group (for example, an acetoxy group, a propionyloxy group, an acryloxy group, a methacryloxy group, a benzoyloxy group, a methanesulfonyloxy group, a benzenesulfonyloxy group, and a benzyloxycarbonyl group); and a halogen atom (for example, a chlorine atom).

Also, in the foregoing general formula (1), so far as M represents a metal atom other than an alkali metal or a silicon atom, M is not particularly limited but is preferably a titanium atom, an aluminum atom, a zirconium atom, or a silicon atom. That is, in the invention, organotitanium compounds, organoaluminum compounds, organoziconium compounds, and silane coupling agents, each of which is substituted with the foregoing organic group or hydrolyzable functional group, are preferably used.

Examples of the silane coupling agent represented by the foregoing general formula (1) include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Especially preferred examples of the silane coupling agent include vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Also, hydrolyzates of the foregoing organometallic compounds and silane coupling agents can be used. Examples of the hydrolyzates include ones resulting from hydrolysis of Y (hydrolyzable group) bonded to M (a metal atom other than an alkali metal or a silicon atom) of the organometallic compound represented by the foregoing general formula (1) or the hydrolyzable group substituted on R (an organic group). Incidentally, in the case where the organometallic compound or silane coupling agent contains plural hydrolyzable groups, it is not always necessary that all of the functional groups are hydrolyzed, but products in which the functional groups are partially hydrolyzed may be employed. Also, these organometallic compounds or silane coupling agents may be used singly or in admixture of two or more kinds thereof.

Examples of a method for subjecting the phthalocyanine pigment to a coating treatment with the foregoing hydrolyzable group-containing organometallic compound and/or silane coupling agent (hereinafter simply referred to as "organometallic compound") include a method in which the phthalocyanine pigment is subjected to a coating treatment during the step of adjusting the crystal of the phthalocyanine pigment; a method in which the phthalocyanine pigment is subjected to a coating treatment before dispersing it into the binding resin; a method in which the organometallic compound is mixed at the time of dispersing the phthalocyanine pigment into the binding resin; and a method in which after dispersing the phthalocyanine pigment into the binding resin, the dispersing treatment with the organometallic compound is further performed.

More specifically, examples of the method of previously performing a coating treatment during the step of adjusting the crystal of the pigment include a method in which the organometallic compound is mixed with the phthalocyanine pigment before the adjustment of the crystal and then heated; a method in which the organometallic compound is mixed with the phthalocyanine pigment before the adjustment of the crystal and then subjected to mechanical dry pulverization; and a method in which a mixed solution of the organometallic compound in water or an organic solvent is mixed with the phthalocyanine pigment before the adjustment of the crystal and then subjected to a wet pulverization treatment.

Also, examples of the method of performing a pulverization treatment of the phthalocyanine pigment before dispersing it into the binding resin include a method in which the organometallic compound, water, a mixed solution of water and an organic solvent, and the phthalocyanine pigment are mixed and heated; a method in which the organometallic compound is directly sprayed onto the phthalocyanine pigment; and a method in which the organometallic compound is mixed with the phthalocyanine pigment and milled.

Also, examples of the method of performing the mixing treatment at the time of dispersing include a method in which the organometallic compound, the phthalocyanine pigment, and the binding resins are added to a dispersing solvent in sequence and mixed; and a method in which these components for forming a charge generation layer are simultaneously added and mixed.

Also, examples of the method in which after dispersing the phthalocyanine pigment into the binding resin, the dispersing treatment with the organometallic compound is further performed include a method in which the organometallic compound diluted with a solvent is added to and dispersed into the dispersion liquid while stirring. Also, for the sake of adhering to the phthalocyanine pigment more firmly in the dispersing treatment, an acid such as sulfuric acid, hydrochloric acid, and trifluoroacetic acid may be added as a catalyst.

Of these methods, a method of previously performing the coating treatment during the step of adjusting the crystal of the phthalocyanine pigment and a method of performing the coating treatment before dispersing the phthalocyanine pigment into the binding resin.

The binding resin to be used in the charge generation layer 23 can be chosen among a wide range of insulating resins and can be chosen among organic photoconductive polymers such as poly-N-vinylcarbazole, polyvinylanthracene, polyvinylpyrene, and polysilanes. Preferred examples of the binding resins include insulating resins such as polyvinylacetal resins, polyarylate resins (for example, a polycondensate of bisphenol A and phthalic acid), polycarbonate resins, polyester resins, phenoxy resins, a vinyl chloride-vinyl acetate copolymer, polyamide resins, acrylic resins, polyacrylamide resins, polyvinylpyridine resins, cellulose resins, urethane resins, epoxy resins, casein, polyvinyl alcohol resins, and polyvinylpyrrolidone resins. Of these, polyvinylacetal resins are especially preferable. These binding resins may be used singly or in combinations of two or more kinds thereof. A compounding ratio (weight ratio) of the charge generation substance to the binding resin in the charge generation layer 23 is preferably in the range of from 10/1 to 1/10.

The charge generation layer 23 is formed by vacuum vapor deposition of the charge generation material or coating of a coating liquid containing the charge generation material and the binding resin. A solvent of the coating liquid is not particularly limited so far as it can dissolve the binding resin therein and for example, can be arbitrarily chosen among alcohols, aromatic compounds, halogenated hydrocarbons, ketones, ketone alcohols, ethers, esters, etc. Specific examples include methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene. These solvents may be used singly or in admixture of two or more kinds thereof.

As a method for dispersing the foregoing charge generation material and binding resin into the solvent, methods using a roll mill, a ball mill, a vibration mill, an attritor, a sand mill, a colloid mill, a paint shaker, etc. can be employed. In dispersing, the particle size of the charge generation material is preferably not more than 0.5 μm, more preferably not more than 0.3 μm, and further preferably not more than 0.15 μm. Also, for the purpose of enhancing the electric characteristics and image quality, the additives as enumerated in the explanation of the subbing layer 22 can be compounded in the coating liquid for charge generation layer.

Further, examples of a coating method of the coating liquid include a blade coating process, a wire bar coating process, a spray coating process, a dip coating process, a bead coating process, an air knife coating process, and a curtain coating process. Also, for the sake of enhancing the smoothness of a coating film, it is possible to add a trace amount of silicone oil as a leveling agent to the coating liquid. The thickness of the thus obtained charge generation layer 23 is preferably from 0.05 to 5 μm, and more preferably from 0.1 to 2.0 μm.

The charge transport layer 24 is a layer which becomes a superficial surface layer in the electrophotographic photoreceptor 1. Though this charge transport layer 24 is a layer containing a charge transport material and a binding resin, it is preferably a layer further containing a resin particle. By containing a resin particle in the charge transport layer 24, it is possible to enhance lubricity and abrasion resistance of the surface of the photoreceptor and desorption properties of the toner.

Also, in the case where the charge transport layer 24 contains such a resin particle, the content of the resin particle in the charge transport layer 24 is preferably from 0.1 to 40% by weight, and more preferably from 1 to 30% by weight based on the whole amount of the charge transport layer 24. In the case where the content is less than 0.1% by weight, the foregoing effects by the dispersion of the resin particle tend to be not thoroughly obtained. On the other hand, when it exceeds 40% by weight, the light transmission is lowered, and an increase of the residual potential caused due to the repeated use tend to be generated.

As the foregoing resin particle, fluorine based resin particles are preferable. Above all, it is preferable that the resin particle is at least one resin selected from the group consisting of a tetrafluoroethylene resin, a trifluorochloroethylene resin, a hexafluoropropylene resin, a vinyl fluoride resin, a vinylidene fluoride resin, a difluorodichloroethylene resin, and copolymers of two or more of tetrafluoroethylene, trifluorochloroethylene, hexafluoroethylene-propylene, vinyl fluoride resin, vinylidene fluoride resin, difluorodichloroethylene resin. Also, of these fluorine based resin particles, a tetrafluoroethylene resin and a vinylidne fluoride resin are preferable.

The average primary particle size of the foregoing resin particle is preferably from 0.05 to 1 μm, and more preferably from 0.1 to 0.5 μm. When the average primary particle size of the resin particle is less than 0.05 μm, coagulation at the time of dispersing tends to likely proceed. On the other hand, when the average primary particle size exceeds 1 μm, an image quality defect tends to be likely generated.

Examples of the charge transport material include hole transport substances such as oxadiazole derivatives (for example, 2,5-bis(p-diethylaminophenyl)-1,3,4-oxadiazole), pyrazoline derivatives (for example, 1,3,5-triphenyl-pyrazoline and 1-[pyridyl-(2)]-3-(p-diethylaminostyryl)-5-(p-diethylaminostyryl)pyrazoline), aromatic tertiary amino compounds (for example, triphenylamine, tri(p-methylphenyl) aminyl-4-amine, dibenzylaniline, tri(p-methyl) phenylamine, N,N'-bis(3,4-dimethylpheny)biphenyl-4-amine, and 9,9-dimethyl-N,N'-di(p-tolyl)fluorenone-2-amine), aromatic tertiary diamino compounds (for example, N,N'-bis(3-methylphenyl)-N,N'-diphenylbenzidine), 1,2,4-triazine derivatives (for example, 3-(4'-dimethylaminophenyl)-5,6-di(4'-methoxyphenyl)-1,2,4-triazine), hydrazone derivatives (for example, 4-diethylaminobenzaldehyde-1,1-dipohenylhydrazone, 4-diphenylaminobenzaldehyde-1,1-diphenylhydrazone, and [p-(diethylamino)-phenyl](1-naphthyl)phenylhydrazone), quinazoline derivatives (for example, 2-phenyl-4-styryl-quinazoline), benzofuran derivatives (for example, 6-hydroxy-2,3-di(p-methoxyphenyl)benzofuran), α-stilbene derivatives (for example, p-(2,2-diphenylvinyl)-N,N-diphenylaniline), enamine derivatives, carbazole derivatives (for example, N-ethylcarbazole), and poly-N-vinylcarbazole and derivatives thereof; electron transport substances such as quinone based compounds (for example, chloranil, bromoanthraquinone, bromoanil quinone, and anthraquinone), tetracyanoquinodimethane based compounds, fluorenone compounds (for example, 2,4,7-trinitrofluorenone and 2,4,5,7-tetranitro-9-fluorenone), oxadiazole based compounds (for example, 2-(4-biphenyl)-5-(4-t-butylphenyl)-1,3,4-oxadiazole, 2,5-bis(naphthyl)-1,3,4-oxadiazole, and 2,5-bis(4-diethylaminophenyl)-1,3,4-oxadiazole), xanthone based compounds, thiophene compounds, and diphenoquinone compounds (for example, 3,3',5,5'-tetra-t-butyldiphenoquinone); and polymers having the group composed of the foregoing compound as the principal chain or side chain. These charge transport materials can be used singly or in combinations of two or more kinds thereof.

Examples of the binding resin include insulating resins (for example, acrylic resins, methacrylic resins, polyarylate resins, polyester resins, polycarbonate resins (for example, bisphenol A type and bisphenol Z type), polystyrene resins, polyvinyl chloride resins, polyvinylidene chloride resins, polyvinyl acetate resins, acrylonitrile-styrene copolymers, acrylonitrile-butadiene copolymers, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, polyvinyl butyral, polyvinyl formal, polysulfones, polyacrylamides, polyamides, chlorine rubbers, poly-N-carbazole, casein, gelatin, polyvinyl alcohol, ethyl cellulose, phenol resins, carboxy-methyl cellulose, vinylidene chloride based polymer waxes, and polyurethanes); and organic photoconductive polymers (for example, polyvinylcarbazole, polyvinylanthracene, and polyvinylpyrene). Of these, electrically insulating resins are preferable; and polycarbonate resins, polyester resins, methacrylic resins, and acrylic resins are preferably used because of their excellent compatibility with charge transport materials, solubility in solvents and strength. These binding resins may be used singly or in combinations of two or more kinds thereof.

The charge transport layer 24 can be formed by coating a solution prepared by dissolving or dispersing the foregoing charge transport material and binding resin and resin particle to be optionally added in a suitable solvent on the charge generation layer 23 and drying the coated solution. The solvent which can be used for forming the charge transport layer include aromatic hydrocarbon based solvents (for example, toluene and chlorobenzene), aliphatic alcohol based solvents (for example, methanol, ethanol, and n-butanol), ketone based solvents (for example, acetone, cyclohexanone, and 2-butanone), halogenated aliphatic hydrocarbon solvents (for example, methylene chloride, chloroform, and ethylene chloride), cyclic or linear ether based solvents (for example, tetrahydrofuran, dioxane, ethylene glycol, and diethyl ether), and mixed solvents thereof. Incidentally, the compounding ratio of the charge transport material to the binding resin is preferably from 10/1 to 1/5, and more preferably from 6/4 to 3/7. In the case where the compounding ratio falls outside the foregoing range, the electric characteristics and film strength tend to be lowered.

Also, examples of a method for dispersing the foregoing resin particle into the charge transport layer 24 include methods using a roll mill, a ball mill, a vibration ball mill, an attritor, a sand mill, a high-pressure homogenizer, an ultrasonic dispersion machine, a colloid mill, a collision type medium-less dispersion machine, and a penetration type medium-less dispersion machine.

Examples of a method for dispersing the coating liquid for forming the charge transport layer 24 include a method in which the resin particle is dispersed into a solution of the binding resin and charge transport material, etc. in a solvent.

The temperature in preparing the coating liquid for forming a charge transport layer is preferably from 0° C. to 50° C. Examples of a method for controlling the temperature include cooling with water, cooling with air, cooling with a coolant, adjustment of the room temperature in the production step, warming with warm water, warming with hot air, warming by a heater, preparation of the equipment for producing a coating liquid using materials which hardly cause the generation of heat, preparation of the equipment for producing a coating liquid using materials which are liable to radiate heat, and preparation of the equipment for producing a coating liquid using materials which are liable to store heat. Examples of a pre-mixing method of the coating liquid include methods using a stirrer or stirring blade and methods using a roll mill, a sand mill, an attritor, a ball mill, a high-pressure homogenizer, an ultrasonic wave dispersion machine, etc. Also, as the dispersion method, methods using a sand mill, an attritor, a ball mill, a high-pressure homogenizer, an ultrasonic dispersion machine, a roll mill, etc. can be utilized.

Also, for the purposes of enhancing the dispersion stability of the coating liquid for forming a charge transport layer and preventing coagulation at the time of film formation from occurring, it is effective to add a small amount of a dispersing agent to the coating liquid. Examples of the dispersing agent include fluorine based surfactants, fluorine based polymers, silicone based polymers, and silicone oils.

Examples of the coating method of the coating liquid for forming a charge transport layer include a dip coating process, a ring coating head used coating process, a spray coating process, a roll coater coating process, and a gravure coater coating process. Also, the thickness of the charge transport layer 24 is preferably from 5 to 50 μm, and more preferably from 10 to 40 μm. Further, for the purpose of enhancing the smoothness of the surface, it is possible to add a leveling agent such as silicone oil to the charge transport layer 24.

Also, for the purpose of preventing deterioration of the photoreceptor 1 caused due to ozone or oxidizing gases generated in the image forming apparatus or light or heat, it is possible to add additives such as an antioxidant, a light stabilizer, and a heat stabilizer in the photosensitive layer 26 (for example, the charge generation layer 23 and the charge transport layer 24).

Examples of the foregoing antioxidant include hindered phenols, hindered amines, p-phenylenediamine, arylalkanes, hydroquinone, spirochroman, spiroindanone, and derivatives thereof, organic sulfur compounds, and organic phosphorus compounds.

More specifically, examples of the foregoing phenol based antioxidants include 2,6-di-t-butyl-4-methylphenol, styrenated phenol, n-octadecyl-3-(3',5'-di-t-butyl-4'-hydroxyphenyl) propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butylidene-bis(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxyphenyl)propionate]-methane, and 3,9-bis[2-{3-(3-t-butyl-4-hydroxy-5-methylphenyl)propionyloxy}-1,1-dimethylethyl]-2,4,8,10-tetraoxaspiro[5,5]undecane.

Examples of the foregoing hindered amine based compounds include bis(2,2,6,6-tetramethyl-4-piperidyl)sebacate, bis-(1,2,2,6,6-pentamethyl-4-piperidyl)sebacate, 1-[2-{3-(3,5-di-t-butyl-4-hydroxyphenyl)propionyloxy}ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]-undecane-2,4-dione, 4-benzoyloxy-2,2,6,6-tetramethylpiperidine, a dimethyl succinate-1-(2-hydroxyethyl)-4-hydroxy-2,2,6,6-tetramethylpiperizine polycondensate, poly-[{6-(1,1,3,3-tetramethylbutyl)imino-1,3,5-triazine-2,4-diyl}{(2,2,6,6-tetramethyl-4-piperidyl)imino}hexamethylene{(2,3,6,6-tetramethyl-4-piperi)imino}], 2-(3,5-di-t-butyl-4-hydroxybenzyl)-2-n-butylmalonic acid bis-(1,2,2,6,6-pentamethyl-4-piperidyl), and an N,N'-bis-(3-aminopropyl)ethylenediamine-2,4-bis[N-butyl-N-(1,2,2,6,6-pentamethyl-4-piperidyl)amino]-6-chloro-1,3,5-triazine condensate.

Examples of the foregoing organic sulfur based antioxidants include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of the foregoing organic phosphorus based antioxidants include trisnonylphenyl phosphate, triphenyl phosphate, and tris(2,4-di-t-butylphenyl)phosphate.

Of the foregoing antioxidants, the organic sulfur based and organic phosphorus based antioxidants are called a secondary antioxidant, and when they are used in combination with a primary antioxidant such as phenol based or amine based antioxidants, a synergistic effect can be obtained.

Examples of the foregoing light stabilizer include benzophenone based, benzotriazole based, dithiocarbamate based, and tetramethylpiperidine based derivatives. More specifically, examples of the foregoing benzophenone based light stabilizers include 2-hydroxy-4-methoxybenzophenone, 2-hydroxy-4-octoxybenzophenone, and 2,2'-dihydroxy-4-methoxybenzophenone.

Also, examples of the foregoing benzotriazole based light stabilizers include 2-(2'-hydroxy-5'-methylphenyl)-benzotriazole, 2-[2'-hydroxy-3'-(3",4",5",6"-tetrahydrophthalimidomethyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)benzotriazole, 2-(2'-hydroxy-5'-t-octylphenyl)benzotriazole, and 2-(2'-hydroxy-3',5'-di-t-amylphenyl)-benzotriazole. In addition, 2,4-di-t-butylphenyl-3',5'-di-t-butyl-4'-hydroxybenzoate and nickel dibutyl dithiocarbamate may be used.

Also, for the purposes of enhancing the sensitivity, lowering the residual potential, reducing the fatigue at the time of repeated use, and the like, it is possible to contain at least one electron accepting substance in the photosensitive layer 26 (for example, the charge generation layer 23 and the charge transport layer 24). Examples of such an electron accepting substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Of these, fluorenone based or quinone based compounds and benzene derivatives containing an electron withdrawing substituent such as Cl, CN, and $NO_2$ are especially preferable.

Incidentally, the electrophotographic photoreceptor 1 may be one in which a protective layer (not illustrated) is further provided on the charge transport layer 24.

In the case where the photoreceptor 1 is provided with a protective layer, the dynamic hardness of the surface of the photoreceptor 1 is adjusted by properly choosing the materials (such as a binding resin) of the layers 23 to 24 constructing the photosensitive layer 26, the subbing layer 22 and the protective layer, the curing conditions of the binding resin, and so on, and the construction is made such that the dynamic hardness of the surface of the photoreceptor 1 is smaller than the dynamic hardness of the surface of the intermediate transfer belt 9 (preferably the dynamic hardness is from $7\times10^9$ to $13\times10^9$ N/m$^2$).

The protective layer is used for the purposes of preventing chemical changes of the charge transport layer 24 at the time of charging the electrophotographic photoreceptor 1 from occurring and further improving the mechanical strength of the photosensitive layer 26. The protective layer is formed by coating a coating liquid containing a conductive material in a suitable binding resin on the photosensitive layer 26.

The conductive material is not particularly limited, and examples thereof include metallocene compounds (for example, N,N-dimethylferrocene), aromatic amine compounds (for example, N,N'-diphenyl-N,N'-bis(3-methylphenyl)-[1,1'-biphenyl]-4,4'-diamine), molybdenum oxide, tungsten oxide, antimony oxide, tin oxide, titanium oxide, indium oxide, tin oxide and antimony, a carrier of a solid solution of barium sulfate and antimony oxide, mixtures of the foregoing metal oxides, mixtures of a single particle of titanium oxide, tin oxide, zinc oxide or barium sulfate with the foregoing metal oxides, a single particle of titanium oxide, tin oxide, zinc oxide or barium sulfate having the foregoing metal oxides coated thereon.

Examples of the binding resin which is used in the protective layer include known resins such as polyamide resins, polyvinyl acetal resins, polyurethane resins, polyester resins, epoxy resins, polyketone resins, polycarbonate resins, polyvinyl ketone resins, polystyrene resins, polyacrylamide resins, polyimide resins, and polyamide-imide resins. Also, if desired, these resins may be crosslinked with each other and provided for use.

The thickness of the protective layer is preferably from 1 to 20 μm, and more preferably from 2 to 10 μm.

Examples of a coating method for forming the protective layer include a blade coating process, a wire bar coating process, a spray coating process, a dip coating process, a bead coating process, an air knife coating process, and a curtain coating process. Also, examples of a solvent which can be used in the coating liquid for forming the protective layer include usual organic solvents such as dioxane, tetrahydrofuran, methylene chloride, chloroform, chlorobenzene, and toluene. These solvents can be used singly or in admixture of two or more kinds thereof. However, it is preferred to use a solvent which hardly dissolves the photosensitive layer 26 on which this coating liquid is coated.

Also, in the electrophotographic photoreceptor 1 illustrated in FIG. 2, the charge generation layer 23 and the charge transport layer 24 are laminated in this order on the conductive substrate 21, but the order of the charge generation layer 23 and the charge transport layer 24 may be reversed. Further, though the electrophotographic photoreceptor 1 illustrated in FIG. 2 is provided with the photosensitive layer 26 of a function separation type in which the charge generation layer 23 and the charge transport layer 24 are individually provided, it may be provided with a photosensitive layer of a sing layer type containing both the charge generation material and the charge transport material.

In the invention, with respect to the photoreceptor 1, it is preferable that at least one layer of the photosensitive layer 26 contains a siloxane based resin having charge transport properties and a crosslinked structure, and an antioxidant. It is more preferable that the content of the antioxidant in one layer of the photosensitive layer 26 containing the antioxidant is from 0.1 to 20% by weight based on the total weight of the one layer of the photosensitive layer. The foregoing siloxane based resin having a crosslinked structure is especially preferable in view of transparency, dielectric breakdown strength, light stability, etc. The foregoing siloxane based resin having a crosslinked structure will be described below.

The foregoing siloxane based resin having a crosslinked structure is a resin in which siloxane, dimethylsiloxane, methylphenylsiloxane, and other necessary components are three-dimensionally crosslinked. However, in the invention, a siloxane based resin having a crosslinked structure containing the following G and F (hereinafter often referred to as "compound (I)") is preferable because it is especially excellent in view of abrasion resistance, charge transport properties, etc. in addition to the foregoing characteristic features.

G: Inorganic vitreous network sub-group

F: Charge transport sub-unit

Also, it is possible to make the following D present between G and F, thereby connecting G and F to each other.

D: Flexible organic sub-unit

Of the foregoing G, an Si group having reactivity is especially preferable and causes crosslinking reaction each other to form a three-dimensional Si—O—Si bond, namely an inorganic vitreous network. Specifically, examples of G include a substituted silicon group having a hydrolyzable group, which is represented by $—SiR^1_{(3-a)}Q_a$. Here, $R^1$ represents a hydrogen atom, an alkyl group, or a substituted or unsubstituted aryl group; Q represents a hydrolyzable group; and a represents an integer of from 1 to 3.

The foregoing D functions to bind F for imparting charge transport properties to the three-dimensional inorganic vitreous network G by direct bonding. Also, D works to imparts proper flexibility to the inorganic vitreous network which is rigid but brittle, thereby enhancing the strength as a film. Specific examples of D include divalent hydrocarbon groups represented by $—C_nH_{2n}—$, $—C_nH_{(2n-2)}—$, or $C_nH_{(2n-4)}—$ (wherein n represents an integer of from 1 to 15), —COO—, —S—, —O—, $—CH_2—C_6H_4—$, —N═CH—, $—(C_6H_4)—(C_6H_4)—$, combinations thereof, and groups in which a substituent is introduced into the foregoing groups.

Examples of the foregoing F include ones having a structure having photo-carrier transport properties, such as triarylamine based compounds, benzidine based compounds, arylalkane based compounds, aryl-substituted ethylene based compounds, stilbene based compounds, anthracene based compounds, hydrazone based compounds, quinone based compounds, fluorenone based compounds, xanthone based compounds, benzophenone based compounds, a cyanovinyl based compounds, and ethylene based compounds.

Also, in the photoreceptor 1, it is preferable that at least one layer of the photosensitive layer 26 contains an antioxidant; and it is more preferable that the layer containing the foregoing siloxane based resin having a crosslinked structure contains an antioxidant. The content of the antioxidant in one layer of the photosensitive layer 26 which contains the antioxidant is preferably from 0.1 to 20% by weight, and more preferably from 0.1 to 10% by weight based on the total weight of the one layer of the photosensitive layer. In the photoreceptor 1, it is preferable that the layer containing the foregoing siloxane based resin having a crosslinked structure is a superficial surface layer.

Further, in the photoreceptor 1, it is preferable that when only the charging exposure is repeated 100,000 times, the fluctuation of the residual potential is not more than 250 V.

(Intermediate Transfer Belt)

The intermediate transfer belt 9 is a transfer medium when the color toner images of the respective colors formed on the photoreceptors 1*a* to 1*d* are superimposed, and the dynamic hardness of its surface is from $22\times10^9$ to $36\times10^9$ N/m$^2$ and set up such that it is larger than the dynamic hardness of the surface of the photoreceptor 1. When the dynamic hardness of the surface of the intermediate transfer belt 9 exceeds $36\times10^9$ N/m$^2$, damage or an increase of abrasion of the surface of the photoreceptor 1 is liable to take place so that it is difficult to design to prolong the life of the image forming apparatus. Also, the toner image is hardly transferred from the photoreceptor 1 at the time of primary transfer so that a vermiculated image is generated. On the other hand, when the dynamic hardness is less than $22\times10^9$ N/m$^2$, the intermediate transfer belt becomes soft too much so that damage or abrasion of the surface of the intermediate transfer belt 9 is liable to be generated due to the contact with a cleaning unit, etc., thereby making it difficult to design to prolong the life of the image forming apparatus. Incidentally, from the viewpoint of designing to more surely prolong the life of the image forming apparatus, it is preferable that the dynamic hardness of the surface of the intermediate transfer belt 9 is from $24\times10^9$ N/m$^2$ to $35\times10^9$ N/m$^2$.

It is preferable that the intermediate transfer belt 9 contains a thermosetting resin as one of the constitutional components. Examples of the thermosetting resin include polyimide resins, polyamide resins, and polyanilines. Of these, polyimide resins are preferable.

In the case where the intermediate transfer belt 9 contains a polyimide resin, it can be produced according to the following procedures. That is, approximately equimolar amounts of a tetracarboxylic dianhydride or a derivative thereof and a diamine are polymerized in a prescribed solvent to obtain a polyamide acid solution. This polyamide acid solution is fed into a cylindrical mold and spread to form a film (layer), which is further subjected to imide conversion, whereby the intermediate transfer belt 9 comprising a polyimide resin can be obtained.

Examples of the tetracarboxylic dianhydride include compounds represented by the following general formula (2).

(2)

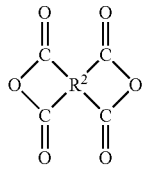

In the formula, $R^2$ represents a tetravalent organic group selected from the group consisting of aliphatic chain hydrocarbon groups, aliphatic cyclic hydrocarbon groups, aromatic hydrocarbon groups, and groups resulting from bonding of a substituent on the foregoing hydrocarbon groups. More specific examples thereof include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis-(3,4-dicarboxyphenyl)sulfonic dianhydride, perylene-3,4,9,10-tetracarboxylic dianhydride, bis(3,4-di-carboxyphenyl) ether dianhydride, and ethylenetetracarboxylic dianhydride.

Also, specific examples of the diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-t-butyl)toluene, bis(p-β-amino-t-butylphenyl) ether, bis(p-β-methyl-β-aminophenyl) benzene, bis-p-(1,1-dimethyl-5-aminopentyl)benzene, 1-isopropyl-2,4-m-phenylenediamine, m-xylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N—(CH_2)_3O(CH_2)_2O(CH_2)NH_2$, $H_2N(CH_2)_3S(CH_2)_3NH_2$, and $H_2N(CH_2)_3N—(CH_3)_2(CH_2)_3NH_2$.

As the solvent in polymerizing the tetracarboxylic anhydride and the diamine, polar solvents are preferable in view of solubility, etc. As the polar solvent, N,N-dialkylamides are preferable. Of these, solvents having a low molecular weight, such as N,N-dimethylformamide, N,N-dimethylacetamide, N,N-diethylformamide, N,N-diethylacetamide, N,N-dimethylmethoxyacetamide, dimethyl sulfoxide, hexamethylphosphoryltriamide, N-methyl-2-pyrrolidone, pyridine, tetramethylenesulfone, and dimethyltetramethylsulfone. These solvents may be used singly or in combinations of two or more kinds thereof.

In the invention, for the purpose of adjusting the film resistance of the intermediate transfer belt 9, it is preferred to disperse carbon into the polyimide resin. The type of the carbon is not particularly limited, but it is preferred to use oxidation treated carbon black in which an oxygen-containing functional group (for example, a carboxyl group, a quinone group, a lactone group, and a hydroxyl group) is formed on the surface of carbon black by an oxidation treatment thereof. In the case where the oxidation treated carbon black is dispersed into the polyimide resin, when a voltage is applied, an excessive current flows into the oxidation treated carbon black, and therefore, the polyimide resin is hardly affected by the oxidation upon repeated application of a voltage. Also, since the oxidation treated carbon black is high in dispersibility into the polyimide resin by the oxygen-containing functional group formed on the surface thereof, not only it is possible to make a scatter of the resistance small, but also the electric field reliability becomes low, whereby concentration of the electric field due to the transfer voltage hardly occurs. Accordingly, it is possible to obtain an intermediate transfer body capable of obtaining a high image quality while suppressing the generation of image quality defects such as deletion in a paper running portion, such that a lowering of the resistance due to the transfer voltage is prevented, that the uniformity of the electric resistance is improved, that the electric field reliability is low, and that changes of the resistance due to the circumference are small.

The foregoing oxidation treated carbon black can be obtained by an air oxidation method in which carbon black is brought into contact with and reacted with air in a high temperature atmosphere, a method in which carbon black is reacted with a nitrogen oxide or ozone at the ambient temperature, a method in which carbon black is oxidized with air at high temperatures and then oxidized with ozone at low temperatures, or other methods. Also, as the oxidization treated carbon black, commercially available products such as MA100 (pH: 3.5, volatile matter content: 1.5%), MA100R (pH: 3.5, volatile matter content: 1.5%), MA100S (pH: 3.5, volatile matter content: 1.5%), #970 (pH: 3.5, volatile matter content: 3.0%), MA11 (pH: 3.5, volatile matter content: 2.0%), #1000 (pH: 3.5, volatile matter content: 3.0%), #2200 (pH: 3.5, volatile matter content: 3.5%), MA230 (pH: 3.0, volatile matter content: 1.5%), MA220 (pH: 3.0, volatile matter content: 1.0%), #2650 (pH: 3.0, volatile matter content: 8.0%), MA7 (pH: 3.0, volatile matter content: 3.0%), MA8 (pH: 3.0, volatile matter content: 3.0%), OIL7B (pH: 3.0, volatile matter content: 6.0%), MA77 (pH: 2.5, volatile matter content: 3.0%), #2350 (pH: 2.5, volatile matter content: 7.5%), #2700 (pH: 2.5, volatile matter content: 10.0%), and #2400 (pH: 2.5, volatile matter content: 9.0%), all of which are manufactured by Mitsubishi Chemical Corporation; Printex 150T (pH: 4.5, volatile matter content: 10.0%), Special Black 350 (pH: 3.5, volatile matter content: 2.2%), Special Black 100 (pH: 3.3, volatile matter content: 2.2%), Special Black 250 (pH: 3.1, volatile matter content: 2.0%), Special Black 5 (pH: 3.0, volatile matter content: 15.0%), Special Black 4 (pH: 3.0, volatile matter content: 14.0%), Special Black 4A (pH: 3.0, volatile matter content: 14.0%), Special Black 550 (pH: 2.8, volatile matter content: 2.5%), Special Black 6 (pH: 2.5, volatile matter content: 18.0%), Color Black FW200 (pH: 2.5, volatile matter content: 20.0%), Color Black FW2 (pH: 2.5, volatile matter content: 16.5%), and Color Black FW2V (pH: 2.5, volatile matter content: 16.5%), all of which are manufactured by Degussa AG; and MONARCH 1000 (pH: 2.5, volatile matter content: 9.5%), MONARCH 1300 (pH: 2.5, volatile matter content: 9.5%), MONARCH 1400 (pH: 2.5, volatile matter content: 9.0%), MOGUL-L (pH: 2.5, volatile matter content: 5.0%), and REGAL 400R (pH: 4.0, volatile matter content: 3.5%), all of which are manufactured by Cabot Corporation, may be used.

The foregoing oxidation treated carbon blacks are different with respect to the conductivity depending upon differences in physical properties such as a degree of the oxidation treatment, a DBP oil absorption, and a specific surface area by the BET method utilizing nitrogen adsorption. The oxidation treated carbon blacks may be used singly or in combinations of two or more kinds thereof, and a combination of two or more kinds of carbon blacks having substantially different conductivity from each other is preferable for use. In the case where two or more kinds of carbon blacks having different physical properties from each other are added, for example, it is possible to adjust the surface resistivity by preferentially adding carbon black capable of revealing high conductivity and then adding carbon black having low conductivity.

The compounding amount of the oxidation treated carbon black is preferably from 10 to 50 parts by weight, and more preferably from 12 to 30 parts by weight based on 100 parts by weight of the polyimide resin. When the compounding amount is less than 10 parts by weight, the uniformity of the electric resistance is lowered, and a lowering of the surface resistivity may possibly become large at the time of endurance use. On the other hand, when it exceeds 50 parts by weight, the desired resistance value is hardly obtained, and the resulting product may possibly become brittle as a molding.

Examples of a method of producing the polyamide acid solution having two or more kinds of oxidation treated carbon blacks dispersed therein include a method in which the foregoing acid dianhydride component and diamine component are dissolved in and polymerized with a dispersion liquid in which two or more kinds of oxidation treated carbon blacks are previously dispersed in a solvent; and a method in which each of two or more kinds of oxidation treated carbon blacks is dispersed into a solvent to prepare two or more kinds of carbon black dispersion liquids, the acid anhydride component and the diamine component are dissolved in and polymerized with the dispersion liquids, and the respective polyamide acid solutions are mixed.

The intermediate transfer belt 9 is obtained by feeding and spreading the thus obtained polyamide acid solution onto the internal surface of a cylindrical mold to form a film and subjecting the polyamide acid to imide conversion upon heating. In the imide conversion, by keeping for 0.5 hours or more at a prescribed temperature, it is possible to obtain the intermediate transfer belt 9 having a good flatness.

Examples of a method for feeding the polyamide acid solution onto the internal surface of the cylindrical mold include a method using a dispenser and a method using a die. Here, as the cylindrical mold, it is preferred to use one in which the internal peripheral surface thereof is mirror finished.

Also, examples of a method for forming a film from the polyamide acid solution fed into the mold include a method of centrifugal molding while heating, a method of molding using a bullet-like running body, and a method of rotary molding. The film having a uniform thickness is formed by these methods.

Examples of a method for forming the intermediate transfer belt 9 by subjecting the thus formed film to imide conversion include (i) a method in which the film is charged into a drying machine together with the mold, and the temperature is raised to the reaction temperature of the imide conversion; and (ii) a method in which after removing the solvent to such extent that the shape as a belt can be kept, the film is peeled apart from the internal surface of the mold and replaced on the external surface of a metallic cylinder, and the resulting film is heated together with this cylinder, thereby achieving the imide conversion. In the invention, though the imide conversion can be carried out by any of the foregoing methods (i) and (ii) so far as the dynamic hardness of the surface of the resulting intermediate transfer belt 9 meets the foregoing conditions, the imide conversion according to the method (ii) is preferable because an intermediate transfer body having good flatness and external surface precision can be efficiently and surely obtained. The method (ii) will be described below in detail.

In the foregoing method (ii), the heating condition in removing the solvent is not particularly limited so far as the solvent can be removed. But, the heating temperature is preferably from 80 to 200° C., and the heating time is from 0.5 to 5 hours. The molding which has been thus molded such that it can keep its shape as a belt is peeled apart from the internal peripheral surface of the mold, but in this peeling, the internal peripheral surface of the mold may be subjected to a mold release treatment.

Next, the molding which has been heated and cured to such extent that the shape as a belt can be kept is replaced on the external surface of a metallic cylinder, and the resulting molding is heated together with the replaced cylinder, thereby proceeding with the imide conversion reaction of polyamide acid. As such a metallic cylinder, one having a coefficient of linear expansion larger than the polyimide resin is preferable. Also, by making the outer diameter of the cylinder small by a prescribed amount as compared with the inner diameter of the polyimide molding, it is possible to perform heat setting, thereby obtaining an endless belt having a uniform thickness and free from unevenness. Also, it is preferable that the surface roughness (Ra) of the external surface of the metallic cylinder is from 1.2 to 2.0 μm. When the surface roughness (Ra) of the external surface of the metallic cylinder is less than 1.2 μm, since the metallic cylinder itself is too smooth, in the resulting intermediate belt 9, sliding due to contraction of the belt in the axial direction is not generated. Accordingly, stretching is performed in this step, whereby a scatter of the thickness and a lowering of the precision of flatness may possibly occur. On the other hand, when the surface roughness (Ra) of the external surface of the metallic cylinder exceeds 2.0 μm, the external surface of the metallic cylinder is transferred onto the internal surface of the belt-like intermediate transfer body to further generate unevenness on the external surface, whereby an image failure may be easily generated. Incidentally, the surface roughness as referred to in the invention means Ra to be measured according to JIS B601.

Also, the heating conditions in the imide conversion vary depending upon the composition of the polyimide resin. But, the heating temperature is preferably from 220 to 280° C., and the heating time is preferably from 0.5 to 2 hours. By performing the imide conversion under such heating conditions, since the amount of contraction of the polyimide resin becomes larger. Accordingly, by performing the contraction in the axial direction of the belt under mild conditions, it is possible to prevent a scatter of the thickness and a lowering of the precision of flatness from occurring.

It is preferable that the surface roughness (Ra) of the external surface of the intermediated transfer belt 9 comprising the thus obtained polyimide resin is not more than 1.5 μm. When the surface roughness (Ra) of the intermediate transfer body exceeds 1.5 μm, an image quality defect such as a rough feeling tends to be likely generated. Incidentally, it is considered that the rough feeling is caused by a phenomenon that the electric field due to the voltage to be applied or peel discharge in the transfer is locally concentrated in the convex of the surface of the belt to cause modification of the surface of the convex, whereby the resistance is lowered due to revelation of a new conductive passage, resulting in a lowering of the density of the resulting image.

The thus obtained intermediate transfer belt 9 is preferably a seamless belt. In the case of a seamless belt, its thickness can be properly determined depending upon the object for use, but it is preferably from 20 to 500 μm, and more preferably from 50 to 200 μm from the standpoints of mechanical characteristics such as strength and flexibility. Also, the surface resistance of the intermediate transfer body is preferably from 8 to 15 (log Ω/square), and more preferably from 11 to 13 (log Ω/square) in terms of a common logarithm of its surface resistivity (Ω/square). Incidentally, the surface resistivity as referred to herein means a value obtained based on a current value obtained by applying a voltage of 100 V under the circumference at 22° C. and 55% RH and measuring after a lapse of 10 seconds after the start of application of a voltage.

In the light of the above, in the invention, it is essential that the dynamic hardness of the intermediate transfer belt 9 is from $22\times10^9$ to $36\times10^9$ N/m$^2$. Examples of a measure for making the dynamic hardness of the intermediate transfer belt 9 fall within the foregoing range include a method of changing conditions such as molecular structure (of, for example, the polyimide of the intermediate transfer belt 9, C/B content, baking temperature, and molecular weight.

In the invention, the dynamic hardness is measured according to the following method. That is, the dynamic hardness is measured by using a diamond indentator having a sharpness of 115° and a tip radius of curvature of not more than 0.1 μm and indenting the diamond indentator into the surface of the intermediate transfer body at a stress rate of 0.05 N/sec. In detail, the intermediate transfer belt is cut out into a suitable size, and its surface is measured by using a microhardness tester installed with a diamond indentator having a sharpness of 115° and a tip radius of curvature of not more than 0.1 μm. At this time, the indention stress rate is set up at 0.05 mN/sec. The indentation depth is read out from the displacement of the indentator, and the indentation load is read out from a load cell attached to the indentator. The dynamic hardness is determined according to the following expression (a).

$$DH=3.8584P/D^2 \quad \text{(a)}$$

In the expression, DH represents a dynamic hardness (N/m$^2$); P represents an indentation load (N); and D represents an indentation depth (m).

In the case where a lower layer of the surface layer of the intermediate transfer belt 9 is remarkably soft so that the measurement of the dynamic hardness is difficult, the following method is employed for the measurement of the dynamic hardness of only the superficial surface layer. That is, the intermediate transfer belt or the superficial surface layer of the photoreceptor is formed in a thickness of from approximately 1.0 to 10.0 μm on a glass substrate by dip coating, bar coater coating, spray coating, vapor deposition, etc., and this surface is measured by using a microhardness tester installed with a diamond indentator having a sharpness of 115° and a tip radius of curvature of not more than 0.1 μm. At this time, the indention stress rate is set up at 0.09 mN/sec. The indentation depth is read out from the displacement of the indentator, and the indentation load is read out from a load cell attached to the indentator. The dynamic hardness is determined according to the foregoing expression (a).

(Developing Unit)

As the toner to be used in the developing unit (developing units 4*a* to 4*d*) in the image forming apparatus of the invention, one formed according to the following method is useful.

Examples of a method for forming the toner particle include (i) a method in which a mechanical impact force or heat energy is applied to a particle obtained by a kneading pulverization method for kneading, pulverizing and classifying the raw materials, to obtain a toner particle; (ii) an emulsion polymerization coagulation method in which a dispersion liquid containing a binding resin obtained by emulsion polymerization of a polymerizable monomer, a dispersion liquid containing a coloring agent, a dispersion liquid containing a mold release agent, and optionally a dispersion liquid containing an antistatic agent are mixed, coagulated and heat molten to obtain a toner particle; (iii) a suspension polymerization method in which a solution containing a polymerizable monomer as a precursor of a binding resin, a coloring agent, a mold release agent, and optionally an antistatic agent is suspended in an aqueous solvent and polymerized to obtain a toner particle; and (iv) a dissolution suspension method in which a solution containing a binding resin, a coloring agent, a mold release agent, and optionally an antistatic agent is suspended in an aqueous solvent and granulated to obtain a toner particle. Also, a toner particle having a core/shell structure in which the toner particle obtained by the foregoing methods is used as a core particle, and a coagulated particle is further adhered onto the surface of this core particle, followed by heat melting may be employed.

Examples of the foregoing binding resin include homopolymers or copolymers of styrenes (for example, styrene and chlorostyrene), monoolefins (for example, ethylene, propylene, butylene, and isoprene), vinyl esters (for example, vinyl acetate, vinyl propionate, vinyl benzoate, and vinyl butyrate), α-methylene aliphatic monocarboxylic esters (for example, methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate), vinyl ethers (for example, vinyl methyl ether, vinyl ethyl ether, and vinyl butyl ether), and vinyl ketones (for example, vinyl methyl ketone, vinyl hexyl ketone, and vinyl isopropenyl ketone).

Especially representative examples of the binding resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. Also, other examples include polyesters, polyurethanes, epoxy resins, silicone resins, polyamides, modified rosins, and paraffin waxes.

Representative examples of the foregoing coloring agent include magnetic powders (for example, magnetite and ferrite), carbon black, aniline blue, chalco oil blue, chrome yellow, ultramarine blue, Du Pont oil red, quinoline yellow, methylene blue chloride, phthalocyanine blue, malachite green oxalate, lamp black, rose bengale, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Representative examples of the foregoing mold release agent include low molecular polyethylene, low molecular polypropylene, Fischer-Tropsch wax, montan wax, carnauba wax, rice wax, and candelilla wax.

Also, in preparing the toner, an antistatic agent or the like may be externally or internally added to the raw materials, if desired. As the antistatic agent, ones which are known can be used. Examples thereof include azo based metal complex compounds, metal complex compounds of salicylic acid, and antistatic agent of a resin type containing a polar group. Especially, in the case where the toner is produced by the wet type production method, it is preferred to use a material which is sparingly soluble in water from the standpoints of control of the ionic strength and reduction of staining by waste liquid. Also, the toner which is used in the invention may be any of a magnetic toner including a magnetic material or a non-magnetic toner not containing a magnetic material.

With respect to the resulting toner, in the case where an additive such as an abrasive is externally added onto the surface of the toner particle, such can be achieved by mixing the toner particle and the additive in a Henschel mixer or a V-blender, etc. Also, in the case where the toner particle is produced by the wet method, the additive can be externally added by the wet method.

A developer for electrophotography in the invention is comprised of a mixture of the above produced toner and a carrier. Here, as the foregoing carrier, ones which are known can be used. Examples thereof include an iron powder, glass beads, a ferrite powder, a nickel powder, and ones resulting from coating with a resin, etc. on the surface of the foregoing material. Also, the mixing proportion of the toner to the carrier can be properly set up as the need arises. Also, for the purposes of protecting the surface of the photoreceptor, enhancing the cleaning function and reducing the abrasion of the surface layer, a lubricating particle can be used. Examples of the lubricating particle which can be used include solid lubricating agents (for example, graphite, molybdenum disulfide, talc, fatty acids, and fatty acid metal salts), low molecular weight polyolefins (for example, polypropylene, polyethylene, and polybutene), silicones having a softening point upon heating, aliphatic amides (for example, oleic amide, erucic amide, ricinoleic amide, and stearic amide), vegetable waxes (for example, carnauba wax, rice wax, candililla wax, haze wax, and jojoba wax), animal waxes (for example, bees wax), minerals (for example, mantan wax, ozokerite, cerecin, paraffin wax, microcrystalline wax, and Fischer-Tropsch wax), petroleum waxes, and modified products thereof. These materials may be used singly or in combinations. Of these, fatty acid zinc salts are especially excellent for the protection of the surface of the photoreceptor.

In the invention, it is preferable that the toner particle an average shape factor ($ML^2/A$) of from 110 to 135. In the case wherein the average shape factor ($ML^2/A$) is less than 110, when the toner remains on the surface of the photoreceptor after the development, the cleaning performance is largely lowered, whereby cleaning failure may possibly be likely generated. On the other hand, in the case where the average shape factor ($ML^2/A$) exceeds 135, the transfer efficiency of the toner image formed on the surface of the photoreceptor onto the recording medium is lowered, whereby a lowering of the image quality or an increase of the waste toner which has not been utilized for the image formation may possibly occur. Incidentally, it is meant that when the value of the average shape factor ($ML^2/A$) is closed to 100, the shape of the toner particle is closed to a true sphere.

If desired, it is possible to externally add an abrasive or an antistatic agent to the toner particle. As the abrasive, for example, inorganic oxide particles are used. With respect to the material species of the inorganic oxide particles, known inorganic oxide materials can be used. Examples thereof include cerium oxide, strontium titanate, magnesium oxide, alumina, silicon carbide, zinc oxide, silica, titanium oxide, boron nitride, calcium pyrophosphate, zirconia, barium titanate, calcium titanate, and calcium carbonate. Also, composite materials of these materials may be used. Also, it is possible to use other inorganic materials having an ability for abrading and removing deposits and having chemical stability equivalent to that of the foregoing inorganic oxide materials. Of these inorganic oxide particles, a strontium titanate particle is especially preferably used as the abrasive.

The volume average primary particle size (hereinafter often referred to simply as "particle size") of the abrasive is preferably from 0.1 to 3.0 μm, and more preferably from 0.2 to 2.0 μm. In the case where the particle size is less than 0.1 μm, an effect for abrading and removing the deposits is not sufficiently obtained, and the removal of discharge products generated on the surface of the photoreceptor for color tends to become insufficient. On the other hand, in the case where the particle size exceeds 3.0 μm, a scratch is liable to be generated on the surface of the photoreceptor, and the life of the photoreceptor tends to become short.

The addition amount of the abrasive is preferably from 0.1 to 2.0 parts by weight, and more preferably from 0.3 to 1.0 part by weight based on 100 parts by weight of the whole amount of the toner particles in any of cyan, magenta and yellow colors. In the case where the addition amount is less than 0.1 parts by weight, an effect for abrading and removing the deposits is not sufficient, and the removal of discharge products generated on the surface of the photoreceptor may possibly become insufficient. On the other hand, in the case where the addition amount exceeds 2.0 parts by weight, toner cloud may possibly be likely generated.

If desired, other additives than the abrasive to be externally added on the surfaces of the foregoing color particles may be externally added onto the surfaces of the toner particles of all colors to be used in the invention. For example, for the purpose of controlling the powder fluidity and charging properties of the toner particle, it is preferred to use a small inorganic oxide particle having a volume average primary particle size of not more than 40 nm (hereinafter often referred to as "additive A"). Examples of a material which constitutes the additive A include silica, titanium oxide, and aluminum oxide. Also, for the purpose of more effectively controlling the powder fluidity and charging properties, it is preferable that the surface of the additive A is coated by an organic/inorganic composite material or an organic material such as isobutyltrimethoxysilane, n-decyltrimethoxysilane, and silicone oil.

Also, for the purposes of controlling the charging properties of the toner particle and/or enhancing the transfer properties (namely, enhancing the transfer efficiency of the toner image formed on the surface of the photoreceptor utilizing an effect for reducing an adhesive force of the toner particle against the surface of the photoreceptor), it is preferred to use an inorganic oxide particle having a volume average primary particle size of larger than 40 nm, and more preferably 100 nm or more (hereinafter often referred to as "additive B"). In particular, for the sake of enhancing the transfer properties, it is preferable that the volume average primary particle size of the additive B is 100 nm or more.

Examples of a material which can be used for constituting the additive B include silica, titanium oxide, and aluminum oxide. Also, for the purpose of more effectively controlling the charging properties and revealing an effect for enhancing the transfer properties, it is preferable that the surface of the additive B is coated with HMDS (hexamethyldisilazane), methyltrimethoxysilane, tetramethoxysilane, dimethyldichlorosilane, etc.

The image forming apparatus of the invention has the construction as explained previously while referring to FIG. 1 and is provided with the foregoing respective constructions as the electrophotographic photoreceptor, the intermediate transfer belt, and the developing unit.

In the image forming apparatus, the charging unit is not particularly limited. Examples thereof include known charging instruments themselves such as contact type charging instruments using a charging member (for example, conductive or semi-conductive rolls, brushes, films, and rubber blades) and scorotron charging instruments and corotron charging instruments utilizing corona discharge. Of these, contact type charging instruments are preferable because of their excellent ability for compensating the charge. In the foregoing charging unit, in general, a direct current is applied to the foregoing electrophotographic photoreceptor, but an alternating current may be further superimposed and applied.

Examples of a material of the foregoing charging member which can be used include metals (for example, aluminum, iron, and copper), conductive high molecular materials (for example, polyacetylene, polypyrrole, and polythiophene), and materials in which fine particles (for example, carbon black, copper iodide, silver iodide, zinc sulfide, silicon carbide, and metal oxides) are dispersed in an elastomeric material (for example, polyurethane rubbers, silicone rubbers, epichlorohydrin rubbers, ethylene-propylene rubbers, acrylic rubbers, fluorine rubbers, styrene-butadiene rubbers, and butadiene rubbers). Examples of the metal oxides include ZnO, $SnO_2$, $TiO_2$, $In_2O_3$, $MoO_3$, and composite oxides thereof. Also, conductivity may be imparted by containing a perchlorate in the elastomeric material.

Also, the coating layer can be provided on the surface of the charging member. Examples of a material for forming this coating layer include N-alkoxymethylated nylons, cellulose resins, vinylpyridine resins, phenol resins, polyurethanes, polyvinyl butyral, and melamine. These materials may be used singly or in combinations of two or more kinds thereof. Also, emulsion resin based materials, for example, acrylic resin emulsions, polyester resin emulsions, and polyurethanes, especially emulsion resins synthesized by soap-free emulsion polymerization, can be used. For the purpose of further adjusting the resistivity, a conductive agent particle may be dispersed in such a resin, and for the purpose of preventing deterioration, an antioxidant can be contained in the resin. Also, for the purpose of enhancing the film forming properties at the time of forming a coating layer, it is possible to contain a leveling agent or a surfactant in the emulsion resin.

The foregoing charging member has an elastic layer, a conductive layer and a resistant layer and preferably has a volume resistivity of from $10^2$ to $10^{10}$ Ω·cm, and more preferably from $10^4$ to $10^{10}$ Ω·cm. Also, in the case where a voltage is applied to this charging member, any of a direct current or an alternating current can be employed for the application of a voltage. Further, a superimposed one of a direct current voltage and an alternating current voltage can be used.

Also, in the image forming apparatus, the exposure unit is not particularly limited. Examples thereof include optical instruments capable of undergoing desired imagewise exposure on the surface of the foregoing electrophotographic photoreceptor 1 from a light source (for example, semiconductor laser light, LED light, and liquid crystal shutter light) or via a polygon mirror.

Further, in the image forming apparatus, the developing unit can be properly chosen depending upon the purpose. For example, known developing instruments for bringing a single-component based developer or a two-component based developer into contact or non-contact therewith using a brush, a roll, etc. are enumerated.

The image forming apparatus of the invention may be provided an optical destaticizing unit. Examples of such a destaticizing unit include a tungsten lamp and LED; and examples of a light quality to be used in the optical destaticizing process include white light such as a tungsten lamp and red light such as LED light. The lighting intensity in the optical destaticizing process is usually several times to approximately 30 times the quantity of light to exhibit the half-decay exposure sensitivity of the electrophotographic photoreceptor.

Also, the image forming apparatus of the invention may be provided with a fixing unit, if desired. Such a fixing unit is not particularly limited, and examples thereof include known fixing instruments themselves such as a heat roll fixing instrument and an oven fixing instrument. The cleaning unit is not particularly limited, and known cleaning units themselves may be used.

Also, the image forming apparatus of the invention may be further provided with a destaticizing unit such as an erase lighting unit. By this unit, a phenomenon that the residual potential of the electrophotographic photoreceptor is carried over into the next cycle is prevented from occurring, and therefore, the image quality can be further enhanced.

Since the image forming apparatus of the invention is provided with the foregoing electrophotographic photoreceptor 1 and intermediate transfer belt 9, it is possible to stably form an image having a good image quality over a long period of time.

Figure 3:
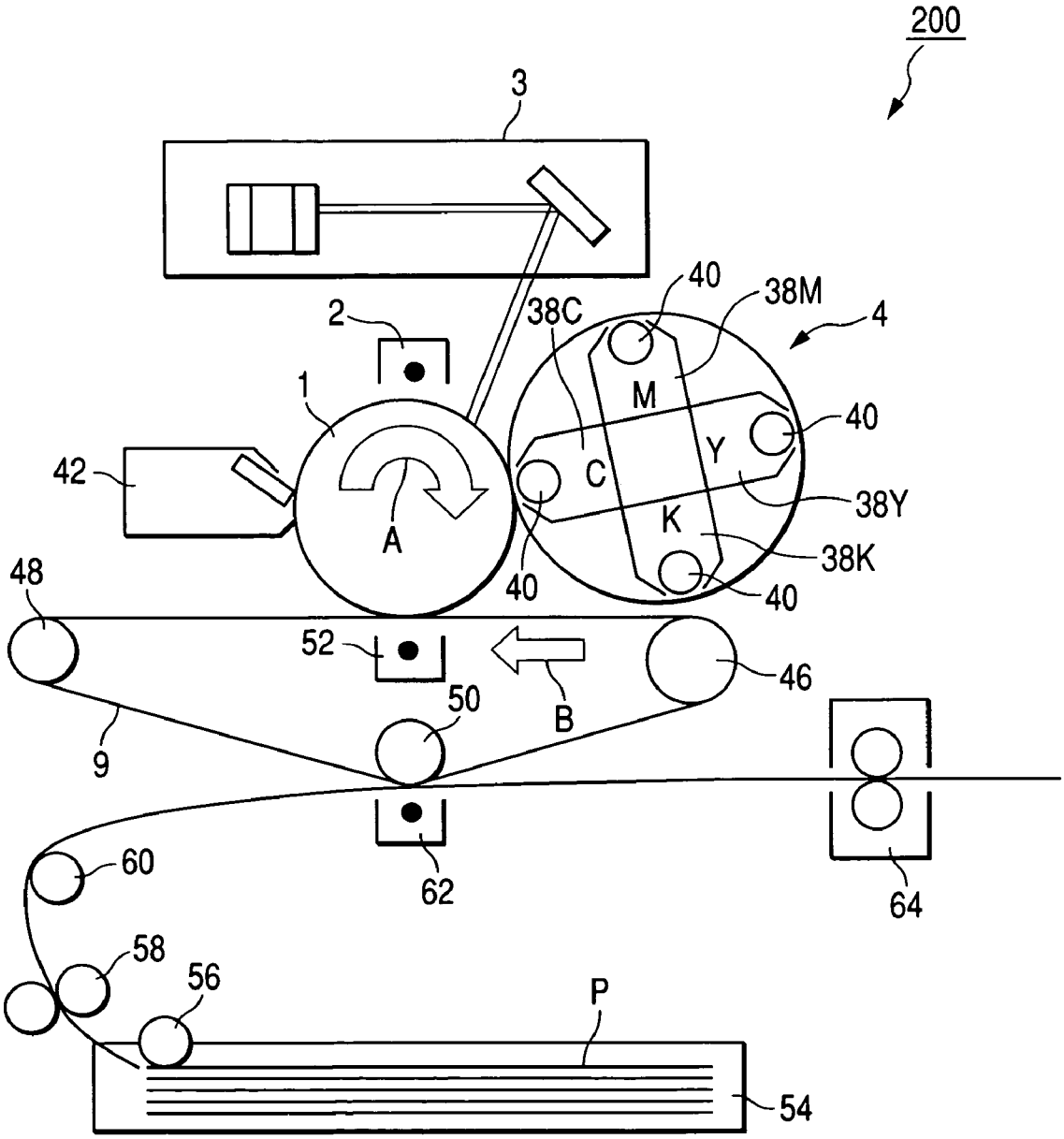
FIG. 3 is a schematic constructive view to show other preferred embodiment of the image forming apparatus of the invention.

The image forming apparatus of the invention is not limited to the image forming apparatus having the construction illustrated in FIG. 1 but for example, may have a construction illustrated in FIG. 3. FIG. 3 is a schematic constructive view to show another preferred embodiment of the image forming apparatus of the invention.

In an image forming apparatus 200 illustrated in FIG. 3, an electrophotographic photoreceptor 1 is made rotatable in the direction of an arrow A at a prescribed rotation speed by a drive unit (not illustrated). A charging unit 2 for charging the external peripheral surface of the electrophotographic receptor 1 is provided approximately above the electrophotographic receptor 1.

Also, an exposure unit 3 is disposed approximately above the charging unit 2. This exposure unit is a non-contact type charging instrument, for example, scorotron charging instruments and corotron charging instruments utilizing corona discharge.

A developing unit 4 is disposed in the side of the electrophotographic photoreceptor 1, and the developing unit 4 is provided with a housing body in the roll-like shape as disposed rotatably. This housing body includes four housing portions, and the respective housing portions are provided with developing instruments 38Y, 38M, 38C, 38K. The developing instruments 38Y, 38M, 38C, 38K are respectively provided with a developing roll 40 and store therein toners of respective yellow (Y), magenta (M), cyan (C) and black (K) colors.

Also, an endless intermediate transfer belt 9 is disposed approximately below of the electrophotographic photoreceptor 1. The intermediate transfer belt 9 is wound around rolls 46, 48, 50, and its external peripheral surface is disposed so as to come into contact with the external peripheral surface of the electrophotographic photoreceptor 1. The rolls 46, 48, 50 are rotated by transmission of a drive force of a motor (not illustrated), thereby rotating the intermediate transfer belt 9 in the direction of an arrow B.

A transfer instrument 52 is disposed in the opposing side to the electrophotographic photoreceptor 1 via the intermediate transfer belt 9. A toner image formed on the external peripheral surface of the electrophotographic photoreceptor 1 is transferred onto the image forming surface of the intermediate transfer belt by the transfer instrument 52.

A tray 54 is disposed in the lower side than the intermediate transfer belt 9, and plural sheets of paper P as a recording material are housed within the tray 24. In FIG. 3, a take-up 56 is disposed in the obliquely upper left side of the tray 54, and a pair of rolls 58 and a roll 60 are disposed in sequence in the downstream side in the take-up direction of the paper P by the take-up roll 56. The recording paper positioned in the uppermost side in the laminated state is taken up from the tray 54 by the rotation of the take-up roll 56 and delivered by the pair of rolls 58 and the roll 60.

Also, a transfer instrument 62 is disposed in the opposing side to the roll 50 via the intermediate transfer belt 9. The paper P delivered by the pair of rolls 58 and the roll 60 is sent between the intermediate transfer belt 9 and the transfer instrument 62, and a toner image formed on the image forming surface of the intermediate transfer belt 9 is transferred by the transfer instrument 62. A fixing instrument 64 provided with a pair of fixing rolls is disposed in the downstream side in the delivery direction of the paper P as compared with the transfer instrument 62; after melt fixing the transferred toner image by the fixing instrument 64, the paper P onto which the toner image has been transferred is discharged out from the machine of the image forming apparatus 200 and then placed on a non-illustrated paper discharge tray.

Also, a destaticizing and cleaning instrument (cleaning unit) 42 having a function to destaticize the external peripheral surface of the electrophotographic photoreceptor 1 and a function to remove an unnecessary toner remaining on the external peripheral surface is disposed in the opposing side to the developing unit 4 via the electrophotographic photoreceptor 1. When the toner image formed on the external surface of the electrophotographic photoreceptor 1 is transferred onto the intermediate transfer belt 9, a region of the external peripheral surface of the electrophotographic photoreceptor 1 where the transferred toner image has been carried is cleaned up by the destaticizing and cleaning instrument 42.

In the image forming apparatus 200 illustrated in FIG. 3, a full-color image is formed in the rotation step in which the electrophotographic photoreceptor 1 is rotated at four revolutions. That is, during the time when the electrophotographic photoreceptor 1 is rotated at four revolutions, the charging unit 2 continues the charging of the external peripheral surface of the electrophotographic photoreceptor 1; the destaticizing and cleaning unit 42 continues the destaticization of the external peripheral surface of the electrophotographic photoreceptor 1; and the exposing unit 3 repeats running of laser beams modulated according to any of Y, M, C or K image data exhibiting a color image to be formed on the external peripheral surface of the electrophotographic photoreceptor 1 while switching the image data to be used for the modulation of laser beams at every revolution of the electrophotographic photoreceptor 1. Also, the developing unit 4 repeats the actuation of the developing instrument corresponding to the external peripheral surface of the electrophotographic photoreceptor 1 in the state that the developing roll 40 of any one of the developing instruments 38Y, 38M, 38C, 38K is corresponding to the external peripheral surface, the development of an electrostatic latent image formed on the external peripheral surface of the electrophotographic photoreceptor 1 into a specified color, and the formation of a toner image of the specified color on the external peripheral surface of the electrophotographic photoreceptor 1 at every revolution of the electrophotographic photoreceptor 1 while rotating the housing body such as the developing instrument to be used for the development of the electrostatic latent image is switched.

In this way, the toner images of Y, M, C and K are successively formed on the external peripheral surface of the electrophotographic photoreceptor 1 at every resolution of the electrophotographic photoreceptor 1 such that they are superimposed each other, whereby a full-color toner image is formed on the external peripheral surface of the electrophotographic photoreceptor 1 at the time of rotating the electrophotographic photoreceptor 1 at four revolutions.

In the image forming apparatus 200 having such a construction, by providing the foregoing electrophotographic photoreceptor 1 and intermediate transfer belt 9, it is also possible to stably form an image having a good image quality over a long period of time.

Incidentally, while examples of the image forming apparatus using color toners have been described in the foregoing two embodiments, the image forming apparatus of the invention may be one for forming a black-and-white image using only a black toner.

EXAMPLES

The invention will be more specifically described below with reference to the following Examples and Comparative Examples, but it should not be construed that the invention is limited thereto.

Example 1

(Preparation of Electrophotographic Photoreceptor)

(1) Preparation of Conductive Substrate:

A drawn tuber made of a aluminum alloy (JIS H4080 (1999), alloy number 3003) and having a diameter of 30 mm and a length of 404 mm is prepared and ground by a centerless grinder so as to have a surface roughness (Rz) of 0.6 μm. This cylinder is subjected to a degreasing treatment as a cleaning step to obtain a conductive substrate.

(2) Formation of Subbing Layer:

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 120° C. for 2 hours to obtain a metal oxide fine particle A.

33 parts by weight of this metal oxide fine particle A, 6 parts by weight of a blocked isocyanate (Sumidur 3175, manufactured by Sumitomo Bayer Urethane Co., Ltd.), and 25 parts by weight of methyl ethyl ketone are mixed for 30 minutes, to which are then added 5 parts by weight of a butyral resin (BM-1, manufactured by Sekisui Chemical Co., Ltd.) and 0.01 parts by weight of a leveling agent (Silicone Oil SH29PA, manufactured by Dow Corning Toray Silicone Co., Ltd.), and the mixture is subjected to a dispersing treatment in a sand mill for 2 hours to obtain a dispersion liquid. 3 parts by weight of a silicone ball (Tospearl 120, manufactured by GE Toshiba Silicones) is further added to this dispersion liquid to obtain a coating liquid for forming a subbing layer.

The resulting coating liquid is coated on the external peripheral surface of the foregoing conductive substrate by the dip coating process and dried for curing at 170° C. for 40 minutes to form a subbing layer (thickness: 23.5 μm).

With respect to this subbing layer, its volume resistance is measured using a gold electrode having a diameter of 1 mm as a counter electrode upon application of an electric field of $10^6$ V/mm. The measurement is carried out under two conditions of high-temperature and high-humidity (at 28° C. and 85% RH) and low-temperature and low-humidity (at 10° C. and 15% RH). At this time, the subbing layer has a volume resistivity of $5\times10^{10}$ Ω·cm at 28° C. and 85% RH and $7\times10^{10}$ Ω·cm at 10° C. and 15% RH, respectively.

(3) Formation of Charge Generation Layer:

Next, 3 parts by weight of hydroxygallium phthalocyanine having diffraction peaks at least at 7.6° and 28.2° in Bragg angles (2θ±0.2°) of the X-ray diffraction spectrum using CuKα rays, 2 parts by weight of a vinyl chloride-vinyl acetate copolymer resin (VMCH, manufactured by Nippon Unicar Company Limited), and 120 parts by weight of n-butyl acetate are subjected to a dispersing treatment in a sand mill for 4 hours to obtain a coating liquid for forming a charge generation layer. The resulting coating liquid is dip coated on the subbing layer and dried at 150° C. for 8 minutes to form a charge generation layer having a thickness of 0.2 μm.

(4) Formation of Charge Transport Layer:

2 parts by weight of a benzidine compound represented by the following formula (3) and 3 parts by weight of bisphenol Z polycarbonate (viscosity average molecular weight: 39,000) are thoroughly dissolved in and mixed with 280 parts by weight of tetrahydrofuran and 120 parts by weight of toluene, to which is then added and mixed 10 parts by weight of a tetrafluoroethylene resin particle to obtain a mixed liquid. At this time, the room temperature is set up at 25° C., and the liquid temperature at the time of mixing is kept at 25° C. Thereafter, the resulting mixed liquid is dispersed in a sand grinder using glass beads to obtain a coating liquid for forming a charge transport layer. At this time, water of 24° C. is flown into a vessel of the sand grinder, thereby keeping the temperature of the dispersion liquid at 50° C. The resulting coating liquid is coated on the charge generation layer by dip coating process and heated at 115° C. for 40 minutes to form a charge transport layer having a thickness of 32 μm. In this way, the preparation of an electrophotographic photoreceptor is completed.

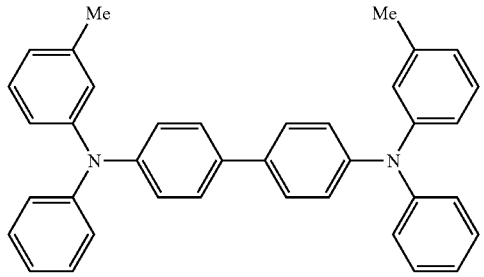

(3)

(Preparation of Toner Particle)

(1) Preparation of Binding Resin Fine Particle Dispersion Liquid:

A solution A prepared by mixing and dissolving 370 parts by weight of styrene, 30 parts by weight of n-butyl acrylate, 8 parts by weight of acrylic acid, 24 parts by weight of dodecane thiol, and 4 parts by weight of carbon tetrabromide; a solution B prepared by dissolving 6 parts by weight of a nonionic surfactant (Nonipol 400, manufactured by Sanyo Chemical Industries, Ltd.) and 10 parts by weight of an anionic surfactant (Neogen SC, manufactured by Dai-ichi Kogyo Seiyaku Co., Ltd.) in 550 parts by weight of ion-exchanged water; and a solution C prepared by dissolving 4 parts by weight of ammonium persulfate in 50 parts by weight of ion-exchanged water are prepared, respectively. Next, the solution A and the solution B are added in a flask, and the solution C is gradually added thereto over 10 minutes while gradually mixing and stirring, thereby performing emulsion polymerization.

After purging the foregoing flask with nitrogen, the resulting mixture is heated with stirring within the flask on an oil bath until the contents reached 70° C., thereby continuing the emulsion polymerization for 5 hours as it is. There is thus obtained a binding resin fine particle dispersion liquid in which a binding resin particle having a volume average primary particle size of 150 nm, a glass transition point Tg of 58° C., and a weight average molecular weight of 11,500 is dispersed in the solution. The concentration of the solids of this binding resin fine particle dispersion liquid is 40% by weight.

(2) Preparation of Coloring Agent Dispersion Liquid (1):

60 parts by weight of carbon black (MOGUL-L, manufactured by Cabot Corporation), 6 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (1) having dispersed therein a coloring agent (carbon black) having an average particle size of 250 nm.

(3) Preparation of Coloring Agent Dispersion Liquid (2):

60 parts by weight of a cyan pigment (C.I. Pigment Blue 15:3), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (2) having dispersed therein a coloring agent (cyan pigment) having an average particle size of 250 nm.

(4) Preparation of Coloring Agent Dispersion Liquid (3):

60 parts by weight of a magenta pigment (C.I. Pigment Red 122), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (3) having dispersed therein a coloring agent (magenta pigment) having an average particle size of 250 nm.

(5) Preparation of Coloring Agent Dispersion Liquid (4):

90 parts by weight of a yellow pigment (C.I. Pigment Yellow 180), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (4) having dispersed therein a coloring agent (yellow pigment) having an average particle size of 250 nm.

(6) Preparation of Mold Release Agent Dispersion Liquid:

100 parts by weight of a paraffin wax (HNP0190, manufactured by Nippon Seiro Co., Ltd., melting point: 85° C.), 5 parts by weight of a cationic surfactant (Sanipol B50, manufactured Kao Corporation), and 240 parts by weight of ion-exchanged water are dispersed for 10 minutes in a round bottom stainless steel-made flask using a homogenizer (Ultra Turrax T50, manufactured by IKA Works), followed by subjecting to a dispersing treatment using a pressure discharge type homogenizer. There is thus obtained a mold release agent dispersion liquid having dispersed therein a mold release agent having an average particle size of 550 nm.

(7) Preparation of Toner Particle K1:

234 parts by weight of the foregoing binding resin fine particle dispersion liquid, 30 parts by weight of the foregoing coloring agent dispersion liquid (1), 40 parts by weight of the foregoing mold release agent dispersion liquid, 0.5 parts by weight of polyaluminum hydroxide (Paho 2S, manufactured by Asada Chemical Co., Ltd.), and 600 parts by weight of ion-exchanged water are mixed and dispersed in a round bottom stainless steel-made flask using a homogenizer (Ultra Turrax T50, manufactured by IKA Works). The resulting mixture is heated to 40° C. on an oil bath for heating while stirring within the flask and then kept at 40° C. for 30 minutes. Thus, it is confirmed that a coagulated particle having a D50 (volume average particle size) of 4.5 μm is formed.

Thereafter, the temperature of the oil bath for heating is raised and kept at 56° C. for one hour. In this case, the D50 is 5.3 μm. After adding 26 parts by weight of the foregoing binding resin fine particle dispersion liquid to this dispersion liquid containing a coagulated particle, the temperature of the oil bath for heating is decreased to 50° C. and kept for 30 minutes. Next, 1N sodium hydroxide is added to this dispersion liquid containing a coagulated particle, thereby adjusting the pH at 7.0, and the stainless steel-made flask is then closed, heated to 80° C. while continuing stirring using a magnetic seal, and kept for 4 hours. After cooling this dispersion liquid containing a coagulated particle, the coagulated particle (toner particle) is filtered off, ished four times with ion-exchanged water, and then freeze dried to obtain a black toner particle K1. The toner particle K1 has a D50 of 5.9 μm and an average shape factor ($ML^2/A$) of 132.

(8) Preparation of Toner Particle C1:

A toner particle C1 of a cyan color is obtained in the same manner as in the preparation method of the foregoing toner particle K1, except for using the coloring agent dispersion liquid (2) in place of the coloring agent dispersion liquid (1). The toner particle C1 have a D50 of 5.8 μm and an average shape factor ($ML^2/A$) of 131.

(9) Preparation of Toner Particle M1:

A toner particle M1 of a magenta color is obtained in the same manner as in the preparation method of the foregoing toner particle K1, except for using the coloring agent dispersion liquid (3) in place of the coloring agent dispersion liquid (1). The toner particle M1 has a D50 of 5.5 μm and an average shape factor ($ML^2/A$) of 135.

(10) Preparation of Toner Particle Y1:

A toner particle Y1 of a yellow color is obtained in the same manner as in the preparation method of the foregoing toner particle K1, except for using the coloring agent dispersion liquid (4) in place of the coloring agent dispersion liquid (1). The toner particle Y1 has a D50 of 5.9 μm and an average shape factor ($ML^2/A$) of 130.

(11) Shape Evaluation of Toner Particle:

The average shape factor ($ML^2/A$) of the toner particle is determined in the following manner. That is, first of all, with respect to 1,000 toner particles, an image of the toner particle is taken into an image analyzer (LUZEX III, manufactured by Nireco Corporation) from an optical microscope, thereby determining the maximum length and area of a projected image of the toner particle. Incidentally, in the case where the toner is placed on the plane, the "maximum length" as referred to herein means a maximum length of a projected image to be formed in projecting the toner by parallel light vertically incident to this plane; and the "area" as referred to herein means an area of this projected image. The shape factor, namely, $\{(\text{maximum length})^2\times\pi\times100/[(\text{area})\times4]\}$ of each toner particle is determined from the maximum length and area, and an average value of the shape factors of these individual toner particles is defined as an average shape factor ($ML^2/A$). Incidentally, in the case of a true sphere, the shape factor is 100.

(Preparation of Developer)

(1) Preparation of Carrier:

First of all, 2 parts by weight of a perfluorooctylethyl methacrylate/methyl methacrylate copolymer (component ratio: 15/85), 0.2 parts by weight of carbon black (VXC72, manufactured by Cabot Corporation), and 14 parts by weight of toluene are stirred for 10 minutes in a sand mill to prepare a coating liquid having been subjected to a dispersing treatment. Next, this coating liquid and 100 parts by weight of a ferrite particle (average particle size: 35 μm) are charged in a vacuum deaeration type kneader and mixed with stirring at a temperature of 60° C. for 30 minutes under a reduced pressure of 560 mmHg (74,660 Pa). Thereafter, the temperature is raised, the pressure is reduced, and the mixture is stirred and dried at 90° C. under 40 mmHg (5,330 Pa) for 30 minutes to obtain a carrier. The resulting carrier has a volume intrinsic resistance value of $10^{11}$ Ω·cm at the time of application of an electric field of 1,000 V/cm.

(2) Preparation of Toners of C, M and Y Colors:

To 100 parts by weight of each of the toner particle C1, the toner particle M1 and the toner particle Y1, 0.55 parts by weight of rutile type titanium oxide (particle size: 20 nm, surface treatment: treated with n-decyltrimethoxysilane), 2.0 parts by weight of a silica (particle size: 140 nm, surface treatment: treated with HMDS, particle preparation method: sol-gel method), 0.4 parts by weight of cerium oxide (E10, particle size: 0.6 μm, manufactured by Mitsui Mining and Smelting Co., Ltd.), and 0.2 parts by weight of zinc stearate (ZNS-S, particle size: 6 μm, manufactured by Asahi Denka Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

To 100 parts by weight of the toner particle K1, 1.0 part by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), and 0.3 parts by weight of zinc stearate (ZNS-S, particle size: 6 μm, manufactured by Asahi Denka Co., Ltd.) are added, and the mixture is treated in the same manner as in the foregoing preparation method as in the toners of C, M and Y colors to obtain a toner of K (black) color onto the surface of which has been externally added the additives.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

(Preparation of Intermediate Transfer Belt)

25 parts by weight of carbon black (Special Black 4, manufactured by Degussa AG) is added to 75 parts by weight of Polyimide U Varnish S for heat resistant film, manufactured by Ube Industries, Ltd., and the mixture is dispersed in a sand mill for 7 hours to prepare a dispersion liquid. This dispersion liquid is coated in a thickness of 400 μm on the external surface of a cylindrical mold by the annular coating process and heated at 150° C. for 45 minutes while rotating at 6 rpm. After returning the temperature to room temperature, the coated mold is placed in a baking furnace and baked at 350° C. for 3 hours, thereby completing the imide conversion reaction.

Thereafter, the temperature is returned to room temperature to obtain a desired intermediate transfer belt. This belt has a thickness of 75 μm and a surface resistivity of 11.7 (log Ω/square) in terms of a common logarithm of its surface resistivity (Ω/square)

(Measurement of Dynamic Hardness)

With respect to the foregoing photoreceptor and intermediate transfer belt, the dynamic hardness is measured in an indentator indentation measurement mode by using a microhardness tester (DUH-201, manufactured by Shimadzu Corporation) installed with a diamond indentator having a sharpness of 115° and a tip radius of curvature of 0.07 μm.

At this time, the indentation pressure is set up at 0.09 mN/sec. Using the following expression (a), the dynamic hardness in a region having an indentation depth of not more than 1.0 μm, which is not affected by the substrate, is calculated, and the calculated value is defined as a dynamic hardness of the surface. The results obtained are shown in Table 1.

$$DH=3.8584P/D^2 \quad (a)$$

In the expression, DH represents a dynamic hardness ($N/m^2$); P represents an indentation load (N); and D represents an indentation depth (m).

(Preparation of Image Forming Apparatus)

The foregoing photoreceptor, intermediate transfer belt and developer are mounted in a tandem type color image forming apparatus (DocuCentre Color 400CP, manufactured by Fuji Xerox Co., Ltd.) to prepare an image forming apparatus having the construction illustrated in FIG. 1. Incidentally, in this Example, one provided with a contact charging roll is used as the charging unit; and one provided with a cleaning blade made of polyurethane is used as the cleaning unit.

(Evaluation of Image Quality)

Using the foregoing image forming apparatus, a printing test for copying a character image is performed to evaluate the image quality. As the condition of the printing test, an operation of printing five sheets with a character image by vertically feeding A4-size papers and taking a resist in next ten sheets is repeated, thereby printing 70,000 sheets in total at a rate of 5,000 sheets per day. At this time, any change of the image quality (state of the generation of image quality defect) is evaluated. Also, any fluctuation of the residual potential on the surface of the photoreceptor after printing the 70,000th sheet (a value obtained by subtracting the residual potential at the time of printing the first sheet from the residual potential at the time of printing the 70,000th sheet) is also confirmed. The results obtained are shown in Table 1.

Example 2

An image forming apparatus of Example 2 is prepared in the same manner as in Example 1, except for preparing a developer in the following procedures. The results of the dynamic hardness of the photosensitive layer and the intermediate transfer belt in Example 2 and the evaluation of image quality are shown in Table 1.

(Preparation of Developer)

(1) Preparation of Carrier:

A carrier is prepared in the same procedures as in Example 1.

(2) Preparation of Toners of C, M and Y Colors:

To 100 parts by weight of each of the toner particle C1, the toner particle M1 and the toner particle Y1, 1.0 part by weight of anatase type titanium oxide (particle size: 20 nm, surface treatment: treated with isobutyltrimethoxysilane), 2.0 parts by weight of silica (particle size: 140 nm, surface treatment: treated with HMDS, particle preparation method: sol-gel method), 0.4 parts by weight of cerium oxide (E10, particle size: 0.6 am, manufactured by Mitsui Mining and Smelting Co., Ltd.), and 0.3 parts by weight of zinc stearate (ZNS-S, particle size: 6 μm, manufactured by Asahi Denka Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

To 100 parts by weight of the toner particle K1, 1.0 part by weight of anatase type titanium oxide (particle size: 20 nm, surface treatment: treated with isobutyltrimethoxysilane), 2.0 parts by weight of silica (particle size: 140 nm, surface treatment: treated with HMDS, particle preparation method: sol-gel method), and 0.3 parts by weight of zinc stearate (ZNS-S, particle size: 6 μn, manufactured by Asahi Denka Co., Ltd.) are added, and the mixture is treated in the same manner as in the foregoing preparation method as in the toners of C, M and Y colors to obtain a toner of K (black) color onto the surface of which has been externally added the additives.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

Example 3

An image forming apparatus of Example 3 is prepared in the same manner as in Example 1, except for using a metal oxide fine particle B prepared in the following procedures in place of the metal oxide fine particle A, preparing a developer in the following procedures and using, as the intermediate transfer belt, one prepared in the following procedures. The results of the dynamic hardness of the photosensitive layer and the intermediate transfer belt in Example 3 and the evaluation of image quality are shown in Table 1.

(Preparation of Metal Oxide Fine Particle B)

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 180° C. for 2 hours to obtain a metal oxide fine particle B.

A subbing layer formed using the foregoing metal oxide fine particle B has a volume resistivity of $3\times10^9$ Ω·cm under 85% RH) and $4\times10^{10}$ Ω·cm under a low-temperature and low-humidity condition (at 10° C. and 15% RH), respectively.

(Preparation of Developer)

(1) Preparation of Carrier:

A carrier is prepared in the same procedures as in Example 1.

(2) Preparation of Toners of C, M and Y Colors:

To 100 parts by weight of each of the toner particle C1, the toner particle M1 and the toner particle Y1, 1.0 part by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method:

sol-gel method), 2.0 parts by weight of silica (particle size: 40 nm, surface treatment: treated with silicone oil, particle preparation method: vapor phase oxidation method), and 0.2 parts by weight of zinc stearate (ZNS-S, particle size: 6 μm, manufactured by Asahi Denka Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

A toner of K (black) color onto the surface of which has been externally added the additives is obtained in the same procedures as in Example 1.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

(Preparation of Intermediate Transfer Belt)

25 parts by weight of carbon black (Special Black 4, manufactured by Degussa AG) is added to 75 parts by weight of Polyimide U Varnish A for heat resistant film, manufactured by Ube Industries, Ltd., and the mixture is dispersed in a sand mill for 7 hours to prepare a dispersion liquid. This dispersion liquid is coated in a thickness of 400 μm on the external surface of a cylindrical mold by the annular coating process and heated at 150° C. for 60 minutes while rotating at 6 rpm. After returning the temperature to room temperature, the coated mold is placed in a baking furnace and baked at 300° C. for 2.5 hours, thereby completing the imide conversion reaction.

Thereafter, the temperature is returned to room temperature to obtain a desired intermediate transfer belt. This belt has a thickness of 75 μm and a surface resistivity of 12.0 (log Ω/square) in terms of a common logarithm of its surface resistivity (Ω/square).

Example 4

An image forming apparatus of Example 4 is prepared in the same manner as in Example 1, except for using a metal oxide fine particle C prepared in the following procedures in place of the metal oxide fine particle A. The results of the dynamic hardness of the photosensitive layer and the intermediate transfer belt in Example 4 and the evaluation of image quality are shown in Table 1.

(Preparation of Metal Oxide Fine Particle C)

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 250° C. for 2 hours to obtain a metal oxide fine particle C.

A subbing layer formed using the foregoing metal oxide fine particle C has a volume resistivity of $2\times10^{8}$ Ω·cm under a high-temperature and high-humidity condition (at 28° C. and 85% RH) and $4\times10^{10}$ Ω·cm under a low-temperature and low-humidity condition (at 10° C. and 15% RH), respectively.

Example 5

An image forming apparatus of Example 5 is prepared in the same manner as in Example 1, except for using, as the intermediate transfer belt, one prepared in the following procedures. The results of the dynamic hardness of the photosensitive layer and the intermediate transfer belt in Example 5 and the evaluation of image quality are shown in Table 1.

(Preparation of Intermediate Transfer Belt)

12 parts by weight of Polyimide U Varnish A for heat resistant film, manufactured by Ube Industries, Ltd. and 60 parts by weight of Polyimide U Varnish S for heat resistant film, manufactured by Ube Industries, Ltd. are mixed, to which is then added 28 parts by weight of carbon black (Special Black 4, manufactured by Degussa AG), and the mixture is dispersed in a sand mill for 8 hours to prepare a dispersion liquid. This dispersion liquid is coated in a thickness of 400 μm on the external surface of a cylindrical mold by the annular coating process and heated at 150° C. for 60 minutes while rotating at 10 rpm. After returning the temperature to room temperature, the coated mold is placed in a baking furnace and baked at 300° C. for 2.5 hours, thereby completing the imide conversion reaction.

Thereafter, the temperature is returned to room temperature to obtain a desired intermediate transfer belt. This belt has a thickness of 75 μm and a surface resistivity of 11.9 (log Ω/square) in terms of a common logarithm of its surface resistivity (Ω/square).

Example 6

An image forming apparatus of Example 6 is prepared in the same manner as in Example 5, except that bisphenol Z polycarbonate (viscosity average molecular weight: 80,000) is used in place of the bisphenol Z polycarbonate (viscosity average molecular weight: 39,000) which is a material of constructing the charge transport layer of the electrophotographic photoreceptor and that in the preparation of the intermediate transfer belt, 18 parts by weight of Polyimide U Varnish A for heat resistant film, manufactured by Ube Industries, Ltd. and 54 parts by weight of Polyimide U Varnish S for heat resistant film, manufactured by Ube Industries, Ltd. are mixed, to which is then added 28 parts by weight of carbon black (Special Black 4, manufactured by Degussa AG), and the mixture is dispersed in a sand mill for 7 hours to prepare a dispersion liquid. The results of the dynamic hardness of the photosensitive layer and the intermediate transfer belt in Example 6 and the evaluation of image quality are shown in Table 1.

Example 7

An image forming apparatus of Example 7 is prepared in the same manner as in Example 5, except that bisphenol Z polycarbonate (viscosity average molecular weight: 30,000) is used in place of the bisphenol Z polycarbonate (viscosity average molecular weight: 39,000) which is a material of constructing the charge transport layer of the electrophotographic photoreceptor and that in the preparation of the intermediate transfer belt, 54 parts by weight of Polyimide U Varnish A for heat resistant film, manufactured by Ube Industries, Ltd. and 18 parts by weight of Polyimide U Varnish S for heat resistant film, manufactured by Ube Industries, Ltd. are mixed, to which is then added 28 parts by weight of carbon black (Special Black 4, manufactured by Degussa AG), and the mixture is dispersed in a sand mill for 7.5 hours to prepare a dispersion liquid. Incidentally, this intermediate transfer belt has a thickness of 75 μm and a surface resistivity of 11.0 (log Ω/square) in terms of a common logarithm of its surface resistivity (Ω/square). The results of the dynamic hardness of the photosensitive layer and the intermediate transfer belt in Example 7 and the evaluation of image quality are shown in Table 1.

Comparative Example 1

An image forming apparatus of Comparative Example 1 is prepared in the same manner as in Example 1, except for using, as the electrophotographic photoreceptor, one in which a protective layer has been formed on the charge transport layer in the following procedures and using, as the intermediate transfer belt, one prepared in the following procedures. The results of the dynamic hardness of the photosensitive layer and the intermediate transfer belt in Comparative Example 1 and the evaluation of image quality are shown in Table 1.

(Preparation of Protective Layer)

A solution of 2 parts by weight of a compound represented by the following formula (4), 2 parts by weight of a compound represented by the following formula (5) and 0.5 parts by weight of tetramethoxysilane dissolved in 5 parts by weight of isopropyl alcohol, 3 parts by weight of tetrahydrofuran and 0.3 parts by weight of distilled water is prepared. 0.5 parts by weight of an ion exchange resin (Amberlist 15E, manufactured by Rohm and Haas Company) is added to this solution, and the mixture is hydrolyzed by stirring at room temperature for 24 hours.

(4)

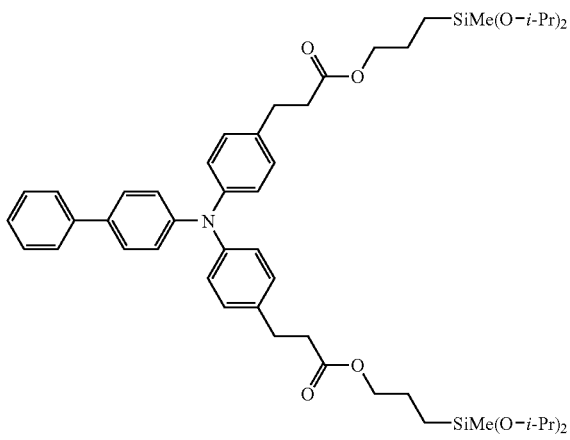

(5)

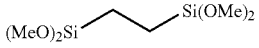

After completion of the hydrolysis, 0.04 parts by weight of aluminum trisacetyl acetonate and 0.1 parts by weight of 3,5-di-t-butyl-4-hydroxytoluene (BHT) are added to 2 parts by weight of a liquid from which the ion exchange resin has been separated by filtration to prepare a coating liquid for forming a protective layer. This coating liquid is coated on the charge transport layer by the ring type dip coating process and then air dried at room temperature for 30 minutes. Thereafter, the coating film is heat treated for curing at 170° C. for one hour to form a protective layer having a thickness of 3 μm.

(Preparation of Intermediate Transfer Belt)

18 parts by weight of carbon black (Special Black 4, manufactured by Degussa AG) is added to 82 parts by weight of Polyimide U Varnish S for heat resistant film, manufactured by Ube Industries, Ltd., and the mixture is dispersed in a sand mill for 2 hours to prepare a dispersion liquid. This dispersion liquid is coated in a thickness of 400 μm on the external surface of a cylindrical mold by the annular coating process and heated at 150° C. for 60 minutes while rotating at 6 rpm. After returning the temperature to room temperature, the coated mold is placed in a baking furnace and baked at 380° C. for 3 hours, thereby completing the imide conversion reaction.

Thereafter, the temperature is returned to room temperature to obtain a desired intermediate transfer belt. This belt has a thickness of 75 μm and a surface resistivity of 9.5 (log Ω/square) in terms of a common logarithm of its surface resistivity (Ω/square).

Comparative Example 2

An image forming apparatus of Comparative Example 2 is prepared in the same manner as in Example 3, except for using, as the electrophotographic photoreceptor, one in which a protective layer has been formed on the charge transport layer in the same procedures as those in Comparative Example 1 and using, as the intermediate transfer belt, one prepared in the following procedures. The results of the dynamic hardness of the photosensitive layer and the intermediate transfer belt in Comparative Example 2 and the evaluation of image quality are shown in Table 1.

(Preparation of Intermediate Transfer Belt)

32 parts by weight of carbon black (Special Black 4, manufactured by Degussa AG) is added to 68 parts by weight of Polyimide U Varnish A for heat resistant film, manufactured by Ube Industries, Ltd., and the mixture is dispersed in a sand mill for 10 hours to prepare a dispersion liquid. This dispersion liquid is coated in a thickness of 400 μm on the external surface of a cylindrical mold by the annular coating process and heated at 150° C. for 60 minutes while rotating at 6 rpm. After returning the temperature to room temperature, the coated mold is placed in a baking furnace and baked at 220° C. for 2.5 hours, thereby completing the imide conversion reaction.

Thereafter, the temperature is returned to room temperature to obtain a desired intermediate transfer belt. This belt has a thickness of 75 μm and a surface resistivity of 9.6 (log Ω/square) in terms of a common logarithm of its surface resistivity (Ω/square).

Comparative Example 3

An image forming apparatus of Comparative Example 3 is prepared in the same manner as in Example 1, except for using, as the electrophotographic photoreceptor, one in which a subbing layer has been formed in the following procedures. The results of the dynamic hardness of the photosensitive layer and the intermediate transfer belt in Comparative Example 3 and the evaluation of image quality are shown in Table 1.

(Formation of Subbing Layer)

One part by weight of a copolymer nylon resin (Amilan CM8000, manufactured by Toray Industries, Inc.) is dissolved in a mixed liquid of 6 parts by weight of methanol and 4 parts by weight of butanol to prepare a coating liquid for forming a subbing layer. The resulting coating liquid is coated on the external surface of the foregoing conductive substrate by the dip coating process and dried for curing at 100° C. for 10 minutes to form a subbing layer (thickness: 0.3 μm).

The volume resistivity of the foregoing subbing layer is $3.1\times10^{14}$ Ω·cm under a high-temperature and high-humidity condition (at 28° C. and 85% RH) but could not be measured under a low-temperature and low-humidity condition (at 10° C. and 15% RH) because it is too high.

Comparative Example 4

An image forming apparatus of Comparative Example 4 is prepared in the same manner as in Example 2, except for using, as the electrophotographic photoreceptor, one in which the thickness of the subbing layer is changed to 5 μm and preparing a developer in the following procedures. The results of the dynamic hardness of the photosensitive layer and the intermediate transfer belt in Comparative Example 4 and the evaluation of image quality are shown in Table 1.

(Preparation of Developer)

(1) Preparation of Carrier:

A carrier is prepared in the same procedures as in Example 1.

(2) Preparation of Toners of C, M and Y Colors:

To 100 parts by weight of each of the toner particle C1, the toner particle M1 and the toner particle Y1, 0.55 parts by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), and 0.4 parts by weight of cerium oxide (E10, particle size: 0.6 μm, manufactured by Mitsui Mining and Smelting Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

A toner of K (black) color onto the surface of which has been externally added the additives is obtained in the same procedures as in Example 1.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

Comparative Example 5

An image forming apparatus of Comparative Example 5 is prepared in the same manner as in Example 3, except for preparing a developer in the following procedures. The results of the dynamic hardness of the photosensitive layer and the intermediate transfer belt in Comparative Example 5 and the evaluation of image quality are shown in Table 1.

(Preparation of Developer)

(1) Preparation of Carrier:

A carrier is prepared in the same procedures as in Example 1.

(2) Preparation of Toners of C, M and Y Colors:

To 100 parts by weight of each of the toner particle C1, the toner particle M1 and the toner particle Y1, 0.55 parts by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), and 0.4 parts by weight of cerium oxide (E10, particle size: 0.6 μm, manufactured by Mitsui Mining and Smelting Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

A toner of K (black) color onto the surface of which has been externally added the additives is obtained in the same procedures as in Example 1.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

TABLE 1

| | Hardness of intermediate transfer belt ($N/m^2$) | Hardness of photoreceptor ($N/m^2$) | Fluctuation of residual potential (V) | State of the generation of image defect |
|---|---|---|---|---|
| Example 1 | 34.2 | 9.5 | −27 | No image defect is generated. |
| Example 2 | 34.2 | 9.5 | −33 | No image defect is generated. |
| Example 3 | 23.2 | 9.5 | −21 | No image defect is generated. |
| Example 4 | 34.2 | 9.5 | −18 | No image defect is generated. |
| Example 5 | 30.8 | 9.5 | −24 | No image defect is generated. |

TABLE 1-continued

| | Hardness of intermediate transfer belt ($N/m^2$) | Hardness of photoreceptor ($N/m^2$) | Fluctuation of residual potential (V) | State of the generation of image defect |
|---|---|---|---|---|
| Example 6 | 27.5 | 11.3 | −35 | No image defect is generated. |
| Example 7 | 25.2 | 8.7 | −38 | No image defect is generated. |
| Comparative Example 1 | 39 | 31.0 | −178 | A scratch is generated on the surface of the photoreceptor due to an Fe based foreign matter to be considered as a carrier, and an image quality defect is generated. |
| Comparative Example 2 | 20.5 | 31.0 | −328 | Breakage of the intermediate transfer belt is generated at the point after printing 17,000 sheets. |
| Comparative Example 3 | 34.2 | 9.5 | −28 | A black spot is generated due to sticking of a foreign matter at the point after printing 5,000 sheets. |
| Comparative Example 4 | 34.2 | 9.5 | −304 | A black spot is generated due to sticking of a foreign matter at the point after printing 15,000 sheets; a fog-like image quality is observed in a white portion after printing 50,000 sheets; and thereafter, the image quality became worse. |
| Comparative Example 5 | 34.2 | 9.5 | −278 | A black spot is generated due to sticking of a foreign matter at the point after continuously printing 10,000 sheets; a fog-like image quality is observed in a white portion after printing 40,000 sheets; and thereafter, the image quality became worse. |

As is clear from the results shown in Table 1, it is confirmed that according the image forming apparatuses of the invention (Examples 1 to 7), an image having a good image quality can be stably formed over a long period of time as compared with the image forming apparatuses of Comparative Examples 1 to 5.

Example 8

Preparation of Electrophotographic Photoreceptor (1) Preparation of Conductive Substrate:

A drawn tuber made of a JIS A3003 aluminum alloy (JIS H 4080(1999), alloy number 3003) and having a diameter of 30 mm and a length of 404 mm is prepared and ground by a centerless grinder so as to have a surface roughness (Rz) of 0.6 μm. This cylinder is subjected to a degreasing treatment as a cleaning step to obtain a conductive substrate.

(2) Formation of Subbing Layer:

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 120° C. for 2 hours to obtain a metal oxide fine particle A.

33 parts by weight of this metal oxide fine particle A, 6 parts by weight of a blocked isocyanate (Sumidur 3175, manufactured by Sumitomo Bayer Urethane Co., Ltd.), and 25 parts by weight of methyl ethyl ketone are mixed for 30 minutes, to which are then added 5 parts by weight of a butyral resin (BM-1, manufactured by Sekisui Chemical Co., Ltd.) and 0.01 parts by weight of a leveling agent (Silicone Oil SH29PA, manufactured by Dow Corning Toray Silicone Co., Ltd.), and the mixture is subjected to a dispersing treatment in a sand mill for 2 hours to obtain a dispersion liquid. 3 parts by weight of a silicone ball (Tospearl 120, manufactured by GE Toshiba Silicones) is further added to this dispersion liquid to obtain a coating liquid for forming a subbing layer.

The resulting coating liquid is coated on the external peripheral surface of the foregoing conductive substrate by the dip coating process and dried for curing at 180° C. for 30 minutes to form a subbing layer (thickness: 20 μm).

With respect to this subbing layer, its volume resistivity is measured using a gold electrode having a diameter of 1 mm as a counter electrode upon application of an electric field of $10^6$ V/mm. The measurement is carried out under two conditions of high-temperature and high-humidity (at 28° C. and 85% RH) and low-temperature and low-humidity (at 10° C. and 15% RH). At this time, the subbing layer has a volume resistivity of $5\times10^{10}$ Ω·cm at 28° C. and 85% RH and $8\times10^{10}$ Ω·cm at 10° C. and 15% RH, respectively.

(3) Formation of Charge Generation Layer:

Next, 3 parts by weight of hydroxygallium phthalocyanine having diffraction peaks at least at 7.6° and 28.2° in Bragg angles (2θ±0.2°) of the X-ray diffraction spectrum using CuKα rays, 2 parts by weight of a vinyl chloride-vinyl acetate copolymer resin (VMCH, manufactured by Nippon Unicar Company Limited), and 120 parts by weight of n-butyl acetate are subjected to a dispersing treatment in a sand mill for 4 hours to obtain a coating liquid for forming a charge generation layer. The resulting coating liquid is dip coated on the subbing layer and dried at 150° C. for 8 minutes to form a charge generation layer having a thickness of 0.2 μm.

(4) Formation of Charge Transport Layer:

2 parts by weight of a benzidine compound represented by the foregoing formula (3) and 3 parts by weight of bisphenol Z polycarbonate (viscosity average molecular weight: 39,000) are dissolved in 20 parts by weight of chlorobenzene to obtain a coating liquid for forming a charge transport layer. The resulting coating liquid is coated on the charge generation layer by dip coating process and heated at 115°

C. for 40 minutes to form a charge transport layer having a thickness of 32 μm. In this way, the preparation of an electrophotographic photoreceptor is completed.

(Preparation of Toner Particle)

(1) Preparation of Binding Resin Fine Particle Dispersion Liquid:

A solution A prepared by mixing and dissolving 370 parts by weight of styrene, 30 parts by weight of n-butyl acrylate, 8 parts by weight of acrylic acid, 24 parts by weight of dodecane thiol, and 4 parts by weight of carbon tetrabromide; a solution B prepared by dissolving 6 parts by weight of a nonionic surfactant (Nonipol 400, manufactured by Sanyo Chemical Industries, Ltd.) and 10 parts by weight of an anionic surfactant (Neogen SC, manufactured by Dai-ichi Kogyo Seiyaku Co., Ltd.) in 550 parts by weight of ion-exchanged water; and a solution C prepared by dissolving 4 parts by weight of ammonium persulfate in 50 parts by weight of ion-exchanged water are prepared, respectively. Next, the solution A and the solution B are added in a flask, and the solution C is gradually added thereto over 10 minutes while gradually mixing and stirring, thereby performing emulsion polymerization.

After purging the foregoing flask with nitrogen, the resulting mixture is heated with stirring within the flask on an oil bath until the contents reached 70° C., thereby continuing the emulsion polymerization for 5 hours as it is. There is thus obtained a binding resin fine particle dispersion liquid in which a binding resin particle having a volume average primary particle size of 150 nm, a glass transition point Tg of 58° C., and a weight average molecular weight of 11,500 is dispersed in the solution. The concentration of the solids of this binding resin fine particle dispersion liquid is 40% by weight.

(2) Preparation of Coloring Agent Dispersion Liquid (1):

60 parts by weight of carbon black (MOGUL-L, manufactured by Cabot Corporation), 6 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (1) having dispersed therein a coloring agent (carbon black) having an average particle size of 250 nm.

(3) Preparation of Coloring Agent Dispersion Liquid (2):

60 parts by weight of a cyan pigment (C.I. Pigment Blue 15:3), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (2) having dispersed therein a coloring agent (cyan pigment) having an average particle size of 250 nm.

(4) Preparation of Coloring Agent Dispersion Liquid (3):

60 parts by weight of a magenta Pigment (C. I. Pigment Red 122), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (3) having dispersed therein a coloring agent (magenta pigment) having an average particle size of 250 nm.

(5) Preparation of Coloring Agent Dispersion Liquid (4):

90 parts by weight of a yellow pigment (C.I. Pigment Yellow 180), 5 parts by weight of a nonionic surfactant (Nonipol 400, manufactured by Sanyo Chemical Industries, Ltd.), and 240 parts of ion-exchanged water are mixed and dissolved, and the mixture is stirred for 10 minutes using a homogenizer (Ultra Turrax T50, manufactured by IKA Works), followed by subjecting to a dispersing treatment using an ultimizer. There is thus obtained a coloring agent dispersion liquid (4) having dispersed therein a coloring agent (yellow pigment) having an average particle size of 250 nm.

(6) Preparation of Mold Release Agent Dispersion Liquid:

100 parts by weight of a paraffin wax (HNP0190, 5 parts by weight of a cationic surfactant (Sanipol B50, manufactured Kao Corporation), and 240 parts by weight of ion-exchanged water are dispersed for 10 minutes in a round bottom stainless steel-made flask using a homogenizer (Ultra Turrax T50, manufactured by IKA Works), followed by subjecting to a dispersing treatment using a pressure discharge type homogenizer. There is thus obtained a mold release agent dispersion liquid having dispersed therein a mold release agent having an average particle size of 550 nm.

(7) Preparation of Toner Particle K1:

234 parts by weight of the foregoing binding resin fine particle dispersion liquid, 30 parts by weight of the foregoing coloring agent dispersion liquid (1), 40 parts by weight of the foregoing mold release agent dispersion liquid, 0.5 parts by weight of polyaluminum hydroxide (Paho 2S, manufactured by Asada Chemical Co., Ltd.), and 600 parts by weight of ion-exchanged water are mixed and dispersed in a round bottom stainless steel-made flask using a homogenizer (Ultra Turrax T50, manufactured by IKA Works). The resulting mixture is heated to 40° C. on an oil bath for heating while stirring within the flask and then kept at 40° C. for 30 minutes. Thus, it is confirmed that a coagulated particle having a D50 (volume average particle size) of 4.5 μm is formed.

Thereafter, the temperature of the oil bath for heating is raised and kept at 56° C. for one hour. In this case, the D50 is 5.3 μm. After adding 26 parts by weight of the foregoing binding resin fine particle dispersion liquid to this dispersion liquid containing a coagulated particle, the temperature of the oil bath for heating is decreased to 50° C. and kept for 30 minutes. Next, 1N sodium hydroxide is added to this dispersion liquid containing a coagulated particle, thereby adjusting the pH at 7.0, and the stainless steel-made flask is then closed, heated to 80° C. while continuing stirring using a magnetic seal, and kept for 4 hours. After cooling this dispersion liquid containing a coagulated particle, the coagulated particle (toner particle) is filtered off, ished four times with ion-exchanged water, and then freeze dried to obtain a black toner particle K1. The toner particle K1 has a D50 of 5.9 μm and an average shape factor ($ML^2/A$) of 132.

(8) Preparation of Toner Particle C1:

A toner particle C1 of a cyan color is obtained in the same manner as in the preparation method of the foregoing toner particle K1, except for using the coloring agent dispersion liquid (2) in place of the coloring agent dispersion liquid (1).

The toner particle C1 has a D50 of 5.8 μm and an average shape factor ($ML^2/A$) of 131.

(9) Preparation of Toner Particle M1:

A toner particle M1 of a magenta color is obtained in the same manner as in the preparation method of the foregoing toner particle K1, except for using the coloring agent dispersion liquid (3) in place of the coloring agent dispersion liquid (1). The toner particle M1 has a D50 of 5.5 μm and an average shape factor ($ML^2/A$) of 135.

(10) Preparation of Toner Particle Y1:

A toner particle Y1 of a yellow color is obtained in the same manner as in the preparation method of the foregoing toner particle K1, except for using the coloring agent dispersion liquid (4) in place of the coloring agent dispersion liquid (1). The toner particle Y1 has a D50 of 5.9 μm and an average shape factor ($ML^2/A$) of 130.

(11) Shape Evaluation of Toner Particle:

The average shape factor ($ML^2/A$) of the toner particle is determined in the following manner. That is, first of all, with respect to 1,000 toner particles, an image of the toner particle is taken into an image analyzer (LUZEX III, manufactured by Nireco Corporation) from an optical microscope, thereby determining the maximum length and area of a projected image of the toner particle. Incidentally, in the case where the toner is placed on the plane, the "maximum length" as referred to herein means a maximum length of a projected image to be formed in projecting the toner by parallel light vertically incident to this plane; and the "area" as referred to herein means an area of this projected image. The shape factor, namely, $\{(\text{maximum length})^2\times\pi\times100/[(\text{area})\times4]\}$ of each toner particle is determined from the maximum length and area, and an average value of the shape factors of these individual toner particles is defined as an average shape factor ($ML^2/A$). Incidentally, in the case of a true sphere, the shape factor is 100.

(Preparation of Developer)

(1) Preparation of Carrier:

First of all, 2 parts by weight of a perfluorooctylethyl methacrylate/methyl methacrylate copolymer (component ratio: 15/85), 0.2 parts by weight of carbon black (VXC72, manufactured by Cabot Corporation), and 14 parts by weight of toluene are stirred for 10 minutes in a sand mill to prepare a coating liquid having been subjected to a dispersing treatment. Next, this coating liquid and 100 parts by weight of a ferrite particle (average particle size: 35 μm) are charged in a vacuum deaeration type kneader and mixed with stirring at a temperature of 60° C. for 30 minutes under a reduced pressure of 560 mmHg (74,660 Pa). Thereafter, the temperature is raised, the pressure is reduced, and the mixture is stirred and dried at 90° C. under 40 mmHg (5,330 Pa) for 30 minutes to obtain a carrier. The resulting carrier has a volume intrinsic resistance value of $10^{11}$ Ω·cm at the time of application of an electric field of 1,000 V/cm.

(2) Preparation of Toners of C, M and Y Colors:

To 100 parts by weight of each of the toner particle C1, the toner particle M1 and the toner particle Y1, 0.55 parts by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), 0.4 parts by weight of cerium oxide (E10, particle size: 0.6 μm, manufactured by Mitsui Mining and Smelting Co., Ltd.), and 0.2 parts by weight of zinc stearate (ZNS-S, particle size: 6 μm, manufactured by Asahi Denka Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

To 100 parts by weight of the toner particle K1, 1.0 part by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), and 0.3 parts by weight of zinc stearate (ZNS-S, particle size: 6 μm, manufactured by Asahi Denka Co., Ltd.) are added, and the mixture is treated in the same manner as in the foregoing preparation method as in the toners of C, M and Y colors to obtain a toner of K (black) color onto the surface of which has been externally added the additives.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

(Preparation of Intermediate Transfer Belt)

An intermediate transfer belt is prepared in the same procedures as in Example 1.

(Measurement of Dynamic Hardness)

With respect to the foregoing photoreceptor and intermediate transfer belt, the dynamic hardness is measured in the same method as the measurement method in Example 1. The results obtained are shown in Table 2.

(Preparation of Image Forming Apparatus)

The foregoing photoreceptor, intermediate transfer belt and developer are mounted in a tandem type color image forming apparatus (DocuCentre Color 500, manufactured by Fuji Xerox Co., Ltd.) to prepare an image forming apparatus having the construction illustrated in FIG. 3. Incidentally, in this Example, one provided with a scorotron charging instrument is used as the charging unit; and one provided with a cleaning blade made of polyurethane is used as the cleaning unit.

(Evaluation of Image Quality)

Using the foregoing image forming apparatus, a printing test for copying a character image is performed to evaluate the image quality. As the condition of the printing test, a process speed is set up at 420 mm/sec, and an operation of printing five sheets with a character image by vertically feeding A4-size papers and taking a resist in next ten sheets is repeated, thereby printing 70,000 sheets in total at a rate of 5,000 sheets per day. At this time, any change of the image quality (state of the generation of image quality defect) is evaluated. Also, any fluctuation of the residual potential on the surface of the photoreceptor after printing the 70,000th sheet (a value obtained by subtracting the residual potential at the time of printing the first sheet from the residual potential at the time of printing the 70,000th sheet) is also confirmed. Further, any change of the charging properties after printing 70,000th sheet (a value obtained by subtracting the charge potential at the time of printing the first sheet from the charge potential at the time of printing the 70,000th sheet) is also confirmed. The results obtained are shown in Table 2.

Example 9

An image forming apparatus of Example 9 is prepared in the same manner as in Example 8, except for using a metal oxide fine particle B prepared in the following procedures in place of the metal oxide fine particle A. The results of the dynamic hardness of the photosensitive layer and the intermediate transfer belt in Example 9 and the evaluation of image quality made in the same manner as in Example 8 are shown in Table 2.

(Preparation of Metal Oxide Fine Particle B)

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 180° C. for 2 hours to obtain a metal oxide fine particle B.

A subbing layer formed using the foregoing metal oxide fine particle B has a volume resistivity of $3\times10^{9}$ Ω·cm under a high-temperature and high-humidity condition (at 28° C. and 85% RH) and $4\times10^{10}$ Ω·cm under a low-temperature and low-humidity condition (at 10° C. and 15% RH), respectively.

(Preparation of Developer)

(1) Preparation of Carrier:

A carrier is prepared in the same procedures as in Example 8.

(2) Preparation of Toners of C, M and Y Colors:

To 100 parts by weight of each of the toner particle C1, the toner particle M1 and the toner particle Y1, 1.0 part by weight of anatase type titanium oxide (particle size: 20 nm, surface treatment: treated with isobutyltrimethoxysilane), 2.0 parts by weight of silica (particle size: 140 nm, surface treatment: treated with HMDS, particle preparation method: sol-gel method), 0.4 parts by weight of cerium oxide (E10, particle size: 0.6 μm, manufactured by Mitsui Mining and Smelting Co., Ltd.), and 0.3 parts by weight of zinc stearate (ZNS-S, particle size: 6 μm, manufactured by Asahi Denka Co., Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta) and Y (yellow) colors, onto the surface of each of which has been externally added the additives.

(3) Preparation of Toner of K Color:

To 100 parts by weight of the toner particle K1, 1.0 part by weight of anatase type titanium oxide (particle size: 20 nm, surface treatment: treated with isobutyltrimethoxysilane), 2.0 parts by weight of silica (particle size: 140 nm, surface treatment: treated with HMDS, particle preparation method: sol-gel method), and 0.3 parts by weight of zinc stearate (ZNS-S, particle size: 6 μm, manufactured by Asahi Denka Co., Ltd.) are added, and the mixture is treated in the same manner as in the foregoing preparation method as in the toners of C, M and Y colors to obtain a toner of K (black) color onto the surface of which has been externally added the additives.

(4) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

Example 10

An image forming apparatus of Example 10 is prepared in the same manner as in Example 8, except for using a metal oxide fine particle D prepared in the following procedures in place of the metal oxide fine particle A, preparing a developer in the following procedures and using, as the intermediate transfer belt, one prepared in the following procedures. The results of the dynamic hardness of the photosensitive layer and the intermediate transfer belt in Example 10 and the evaluation of image quality made in the same manner as in Example 8 are shown in Table 2.

(Preparation of Metal Oxide Fine Particle D)

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 100° C. for 2 hours to obtain a metal oxide fine particle D.

A subbing layer formed using the foregoing metal oxide fine particle D has a volume resistivity of $3\times10^{9}$ Ω·cm under a high-temperature and high-humidity condition (at 28° C. and 85% RH) and $4\times10^{10}$ Ω·cm under a low-temperature and low-humidity condition (at 10° C. and 15% RH), respectively.

(Preparation of Developer)

(1) Preparation of Carrier:

A carrier is prepared in the same procedures as in Example 8.

(2) Preparation of Toners of C, M, Y and K Colors:

To 100 parts by weight of each of the toner particle C1, the toner particle M1, the toner particle Y1 and the toner particle K1, 1.0 part by weight of rutile type titanium oxide (particle size: 20 nm, surface treatment: treated with n-decyltrimethoxysilane), 2.0 parts by weight of silica (particle size: 140 nm, surface treatment: treated with HMDS, particle preparation method: sol-gel method), 2.0 parts by weight of silica (particle size: 40 nm, surface treatment: treated with silicone oil, particle preparation method: vapor phase oxidation method), and 0.2 parts by weight of zinc stearate (ZNS-S, particle size: 6 μm, manufactured by Asahi Denka Co, Ltd.) are added, and the mixture is blended in a 5-L Henschel mixer at a peripheral speed of 30 cm/s for 15 minutes. Thereafter, coarse particles are removed using a sieve having an opening of 45 μm to obtain toners having C (cyan), M (magenta), Y (yellow) and K (black) colors, onto the surface of each of which has been externally added the additives.

(3) Preparation of Developer:

With respect to the respective toners of C, M, Y and K colors, onto the surface of each of which has been externally added the additives, 8 parts by weight of the toner and 100 parts by weight of the foregoing carrier are stirred in a V-blender at 40 rpm for 20 minutes and screened by a sieve having an opening of 212 μm to obtain a developer.

(Preparation of Intermediate Transfer Belt)

An intermediate transfer belt is prepared in the same procedures as in Example 7.

Example 11

An image forming apparatus of Example 11 is prepared in the same manner as in Example 8, except for using a metal oxide fine particle C prepared in the following procedures in place of the metal oxide fine particle A. The results of the dynamic hardness of the photosensitive layer and the intermediate transfer belt in Example 11 and the evaluation of image quality made in the same manner as in Example 8 are shown in Table 2.

(Preparation of Metal Oxide Fine Particle C)

100 parts by weight of zinc oxide (average particle size: 70 nm, a prototype manufactured by Tayca Corporation), 10 parts by weight of a toluene solution containing 10% by weight of N-β-(aminoethyl)-γ-aminopropyltrimethoxysilane as a coupling agent, 20 parts by weight of methanol, and 200 parts by weight of toluene are mixed and refluxed with stirring for 2 hours to obtain a mixed liquid. Thereafter, the toluene is distilled off from the resulting mixed liquid under a reduced pressure of 7.5 hPa (10 mmHg), and the residue is heat treated at 250° C. for 2 hours to obtain a metal oxide fine particle C.

A subbing layer formed using the foregoing metal oxide fine particle C has a volume resistivity of $2\times10^{8}$ Ω·cm under a high-temperature and high-humidity condition (at 28° C. and 85% RH) and $4\times10^{10}$ Ω·cm under a low-temperature and low-humidity condition (at 10° C. and 15% RH), respectively.

Example 12

An image forming apparatus of Example 12 is prepared in the same manner as in Example 8, except for using, as the intermediate transfer belt, one prepared in the following procedures The results of the dynamic hardness of the photosensitive layer and the intermediate transfer belt in Example 12 and the evaluation of image quality made in the same manner as in Example 8 are shown in Table 2.

(Preparation of Intermediate Transfer Belt)

An intermediate transfer belt is prepared in the same procedures as in Example 5.

Comparative Example 6

An image forming apparatus is prepared in the same procedures as in Comparative Example 1. The results of the dynamic hardness of the photosensitive layer and the intermediate transfer belt in Comparative Example 6 and the evaluation of image quality made in the same manner as in Example 8 are shown in Table 2.

Comparative Example 7

An image forming apparatus of Comparative Example 7 is prepared in the same manner as in Comparative Example 4, except for preparing a charge transfer layer in the same procedures as in Example 8. The results of the dynamic hardness of the photosensitive layer and the intermediate transfer belt in Comparative Example 7 and the evaluation of image quality made in the same manner as in Example 8 are shown in Table 2.

TABLE 2

| | Hardness of intermediate transfer belt ($N/m^2$) | Hardness of photoreceptor ($N/m^2$) | Change of charging properties (V) | Fluctuation of residual potential (V) | State of the generation of image defect |
|---|---|---|---|---|---|
| Example 8 | 34.2 | 12.7 | 8 | −27 | No image defect is generated. |
| Example 9 | 34.2 | 12.7 | 9 | −33 | No image defect is generated. |
| Example 10 | 25.2 | 12.7 | 3 | −21 | No image defect is generated. |
| Example 11 | 34.2 | 12.7 | 3 | −18 | No image defect is generated. |
| Example 12 | 30.8 | 12.7 | 8 | −4 | No image defect is generated. |
| Comparative Example 6 | 39 | 31.0 | 8 | −154 | A scratch is generated on the surface of the photoreceptor due to an Fe based foreign matter to be considered as a carrier, and an image quality defect is generated. |
| Comparative Example 7 | 34.2 | 12.7 | 15 | −258 | A black spot is generated due to sticking of a foreign matter at the point after printing 6,000 sheets; a fog-like image quality is observed in a white portion after printing 8,000 sheets; and thereafter, the image quality became worse step by step. |

As is clear from the results shown in Table 2, it is confirmed that according the image forming apparatuses of the invention (Examples 8 to 12), an image having a good image quality can be stably formed over a long period of time as compared with the image forming apparatuses of Comparative Examples 6 to 7.

What is claimed is:

1. An image forming apparatus comprising a photoreceptor which comprises:

a conductive substrate;

a subbing layer disposed on the conductive substrate; and a photosensitive layer disposed on the subbing layer;

a charging unit for charging a surface of the photoreceptor;

an exposure unit for exposing the surface of the photoreceptor to form an electrostatic latent image;

a developing unit for developing the electrostatic latent image with a toner to form a toner image; and a transfer unit having an intermediate transfer belt and for primarily transferring the toner image onto the intermediate transfer belt and secondarily transferring a primarily transferred image on the intermediate belt onto a recording medium, wherein the surface of the intermediate transfer belt has a dynamic hardness of from $22\times10^9$ to $36\times10^9$ N/m$^2$, a dynamic hardness of the surface of the photoreceptor is smaller than the dynamic hardness of the surface of the intermediate transfer belt, the subbing layer has a thickness of 7 μm or more;

a layer of the photoreceptor on the farthest side from the conductive substrate contains a fluorine based resin particle; and the surface of the photoreceptor has a dynamic hardness of from $7\times10^9$ to $13\times10^9$ N/m$^2$.

2. The image forming apparatus according to claim 1, wherein the charging unit is a contact charging unit which comes into contact with the surface of the photoreceptor to charge the photoreceptor, and the developing unit develops the electrostatic latent image with color toners to form color toner images.

3. The image forming apparatus according to claim 1, wherein the surface of the intermediate transfer belt has a dynamic hardness of from $24\times10^9$ to $35\times10^9$ N/m$^2$.

4. The image forming apparatus according to claim 1, wherein the fluorine based resin particle comprises at least one resin selected from the group consisting of:

a tetrafluoroethylene resin, a trifluorochloroethylene resin, a hexafluoroethylene-propylene resin, a vinyl fluoride resin, a vinylidene fluoride resin, a difluorodichloroethylene resin; and copolymers of two or more of tetrafluoroethylene, trifluorochioroethylene, hexafluoroethylene-propylene, vinyl fluoride, vinylidene fluoride, difluorodichioroethylene.

5. The image forming apparatus according to claim 1, wherein the subbing layer contains a metal oxide fine particle and a binding resin, the subbing layer has a volume resistivity when applied with an electric field of $1\times10^6$ V/m at 28° C. and 85% RH, of from $1\times10^8$ to $1\times10^{13}$ Ω·cm, and the subbing layer has a volume resistivity when applied with an electric field of $1\times10^6$ V/m at 10° C. and 15% RH, of not more than 500 times the volume resistivity when applied with an electric field of $1\times10^6$ V/m at 28° C. and 85% RH.

6. The image forming apparatus according to claim 5, wherein the volume resistivity when applied with an electric field of $1\times10^6$ V/m at 28° C. and 85% RH is $1\times10^8$ to $1\times10^{11}$ Ω·cm.

7. The image forming apparatus according to claim 6, wherein the volume resistivity when applied with an electric field of $1\times10^6$ V/m at 10° C. and 15% RH is not more than 100 times the volume resistivity when applied with an electric field of $1\times10^6$ V/m at 28° C. and 85% RH.

8. The image forming apparatus according to claim 5, wherein the metal oxide fine particle is subjected to a coating treatment with at least one coupling agent selected from the group consisting of a silane coupling agent, a titanate based coupling agent, and an aluminate based coupling agent.

9. The image forming apparatus according to claim 5, wherein the coupling agent contains an amino group-containing compound.

10. The image forming apparatus according to claim 1, wherein the subbing layer has a thickness of 15 μm to 30 μm.

11. The image forming apparatus according to claim 1, wherein the photosensitive layer comprises at least one layer, and the at least one layer of the photosensitive layer contains a siloxane based resin having a charge transport property and a crosslinked structure; and an antioxidant.

12. The image forming apparatus according to claim 1, wherein the photosensitive layer comprises at least one layer, and the at least one layer of the photosensitive layer contains at least one kind of phthalocyanine compound.

13. The image forming apparatus according to claim 12, wherein the phthalocyanine compound is hydroxygallium phthalocyanine.

14. The image forming apparatus according to claim 1, wherein the intermediate transfer belt contains a thermosetting polyimide containing at least one kind of carbon black.

15. The image forming apparatus according to claim 14, wherein a surface resistance of the intermediate transfer belt is from 11 to 13 (log Ω/square) in terms of a common logarithm of surface resistivity (Ω/square).

* * * * *